US012454429B2

(12) United States Patent
Takemura

(10) Patent No.: US 12,454,429 B2
(45) Date of Patent: Oct. 28, 2025

(54) ALIGNER, SHEET PROCESSING APPARATUS, AND SHEET WIDTH ALIGNMENT METHOD

(71) Applicant: Glory Ltd., Himeji (JP)

(72) Inventor: Yoichi Takemura, Hyogo (JP)

(73) Assignee: GLORY LTD., Himeji (JP)

( * ) Notice: Subject to any disclaimer, the term of this patent is extended or adjusted under 35 U.S.C. 154(b) by 277 days.

(21) Appl. No.: 18/101,118

(22) Filed: Jan. 25, 2023

(65) Prior Publication Data

US 2023/0234800 A1 Jul. 27, 2023

(30) Foreign Application Priority Data

Jan. 27, 2022 (JP) ..... 2022-011006

(51) Int. Cl.
*B65H 7/10* (2006.01)
*B65H 9/16* (2006.01)

(52) U.S. Cl.
CPC ..... *B65H 7/10* (2013.01); *B65H 9/166* (2013.01); *B65H 2701/1912* (2013.01)

(58) Field of Classification Search
CPC .. B65H 7/10; B65H 9/166; B65H 2404/1441; B65H 2404/15; B65H 2404/152
See application file for complete search history.

(56) References Cited

U.S. PATENT DOCUMENTS 3,135,175 A * 6/1964 Dexter ..... B65H 29/42 198/374
6,896,256 B2 * 5/2005 Hozumi ..... B65H 5/062 271/227
7,648,138 B2 * 1/2010 Hayashi ..... B65H 9/166 271/226
7,686,300 B2 * 3/2010 Watanabe ..... B65H 9/16 271/274
7,950,518 B2 * 5/2011 Fehrenbach ..... B65H 9/002 198/411
2008/0073824 A1 3/2008 Watanabe et al.

FOREIGN PATENT DOCUMENTS

JP H08-208075 A 8/1996
JP H09194081 A * 7/1997 ..... B65H 9/00
JP 2002193537 A * 7/2002 ..... B66B 13/26

OTHER PUBLICATIONS

Extended European Search Report issued Jun. 26, 2023 in European Patent Application No. 23152562.7, 9 pages.

* cited by examiner

*Primary Examiner* — Patrick Cicchino
(74) *Attorney, Agent, or Firm* — XSENSUS LLP

(57) ABSTRACT

Provided is an aligner capable of aligning a sheet during transport in a direction orthogonal to a transport direction. The aligner includes: a transport path; a linear-motion transport unit that generates a drive force in a transport direction along the transport path to a sheet on the transport path; a left-skew transport unit that is disposed in a left direction with respect to the transport direction of the linear-motion transport unit and generates a drive force in a left-oblique direction inclined in the left direction to the sheet on the transport path; and a right-skew transport unit that is disposed in a right direction with respect to the transport direction of the linear-motion transport unit and generates a drive force in a right-oblique direction inclined in the right direction to the sheet on the transport path.

6 Claims, 16 Drawing Sheets

ALIGNER, SHEET PROCESSING APPARATUS, AND SHEET WIDTH ALIGNMENT METHOD

CROSS-REFERENCE TO RELATED APPLICATIONS

The present application claims priority to, and contains subject matter to, JP2022-011006, filed on Jan. 27, 2022, the entire contents of which incorporated herein by reference.

TECHNICAL FIELD

The present disclosure relates to an aligner, a sheet processing apparatus, and a sheet width alignment method.

BACKGROUND

In the related art, there is known an apparatus configured to transport a banknote on a transport path which transports a banknote while adjusting the position thereof in a direction orthogonal to a transport direction (the width direction of the transport path) (see, for example, Patent Literature (hereinafter referred to as "PTL") 1). The apparatus described in PTL 1 aligns a banknote during transport to the width-direction center of a transport path (centers the banknote) by using a roller (linear-motion roller) configured to guide a banknote along a transport direction and a roller (skew roller) configured to guide a banknote in a direction oblique to the transport direction.

CITATION LIST

Patent Literature

PTL 1
U.S. Pat. No. 7,950,518

SUMMARY

An aligner according to the present disclosure comprises: a transport path; a linear-motion transport unit that generates a drive force to a sheet on the transport path, where the drive force is a drive force in a transport direction along the transport path; a left-skew transport unit that is disposed in a left direction with respect to the transport direction of the linear-motion transport unit and generates a drive force to the sheet on the transport path, where the drive force is a drive force in a left-oblique direction inclined in the left direction; and a right-skew transport unit that is disposed in a right direction with respect to the transport direction of the linear-motion transport unit and generates a drive force to the sheet on the transport path, where the drive force is a drive force in a right-oblique direction inclined in the right direction.

A sheet processing apparatus according to the present disclosure is a sheet processing apparatus comprising an aligner that transports a sheet on a transport path. The aligner comprises: the transport path; a linear-motion transport unit that generates a drive force to the sheet on the transport path, where the drive force is a drive force in a transport direction along the transport path; a left-skew transport unit that is disposed in a left direction with respect to the transport direction of the linear-motion transport unit and generates a drive force to the sheet on the transport path, where the drive force is a drive force in a left-oblique direction inclined in the left direction; and a right-skew transport unit that is disposed in a right direction with respect to the transport direction of the linear-motion transport unit and generates a drive force to the sheet on the transport path, where the drive force is a drive force in a right-oblique direction inclined in the right direction.

A sheet width alignment method according to the present disclosure is a sheet width alignment method to be executed by an aligner that transports a sheet on a transport path. The sheet width alignment method comprises transporting, by the aligner, a plurality of the sheets while selectively aligning the plurality of sheets in a left direction or a right direction for each predetermined number of one or the plurality of sheets, where the left direction and the right direction are orthogonal to a transport direction of the sheet. The predetermined number may be settable by an operation of a user.

DETAILED DESCRIPTION

Figure 1:
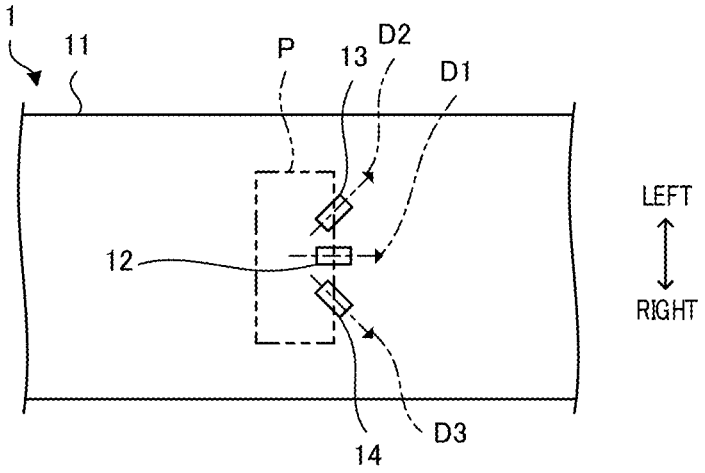
FIG. 1 is a schematic diagram illustrating a state of an aligner viewed from above in Embodiment 1.

PTL 1 described above only discloses that a banknote during transport is centered.

The present disclosure provides an aligner, a sheet processing apparatus, and a sheet width alignment method each capable of aligning a sheet during transport in a direction orthogonal to a transport direction.

An aligner according to the present disclosure comprises: a transport path; a linear-motion transport unit that generates a drive force to a sheet on the transport path, where the drive force is a drive force in a transport direction along the transport path; a left-skew transport unit that is disposed in a left direction with respect to the transport direction of the linear-motion transport unit and generates a drive force to the sheet on the transport path, where the drive force is a drive force in a left-oblique direction inclined in the left direction; and a right-skew transport unit that is disposed in a right direction with respect to the transport direction of the linear-motion transport unit and generates a drive force to the sheet on the transport path, where the drive force is a drive force in a right-oblique direction inclined in the right direction.

In the aligner according to the present disclosure, positions of the linear-motion transport unit, the left-skew transport unit, and the right-skew transport unit may be set so as to be arranged in a row in a direction orthogonal to the transport direction.

The aligner according to the present disclosure may further comprise a control unit that controls the linear-motion transport unit, the left-skew transport unit, and the right-skew transport unit such that the sheet is transported while being selectively aligned leftward or rightward in the transport direction. Here, the term "align" may mean to "shift" such that a position of the sheet is selectively shifted. Here, the term "leftward or rightward" means to be in a left direction or a right direction, where the left direction and the right direction may be orthogonal to the transport direction.

In the aligner according to the present disclosure, in a case where the sheet is aligned in the left direction, the control unit may cause the drive forces by the linear-motion transport unit and the left-skew transport unit to be given to the sheet, and in a case where the sheet is aligned in the right direction, the control unit may cause the drive forces by the linear-motion transport unit and the right-skew transport unit to be given to the sheet.

In the aligner according to the present disclosure, the linear-motion transport unit, the left-skew transport unit, and the right-skew transport unit each may comprise a linear-motion drive roller, a left-skew drive roller, and a right-skew drive roller that are disposed on a side of one main surface of the sheet. In the case where the sheet is aligned in the left direction, the control unit may cause the linear-motion drive roller and the left-skew drive roller to come into contact with the sheet and to rotate, and in the case where the sheet is aligned in the right direction, the control unit may cause the linear-motion drive roller and the right-skew drive roller to come into contact with the sheet and to rotate.

In the aligner according to the present disclosure, in the case where the sheet is aligned in the left direction, the control unit may cause a pressing force of the left-skew drive roller on the sheet to be greater than a pressing force of the linear-motion drive roller on the sheet, and in the case where the sheet is aligned in the right direction, the control unit may cause a pressing force of the right-skew drive roller on the sheet to be greater than the pressing force of the linear-motion drive roller on the sheet.

In the aligner according to the present disclosure, in the case where the sheet is aligned in the left direction, the control unit may cause the left-skew drive roller to rotate such that a component of velocity of the left-skew drive roller in the transport direction is identical to a velocity of rotation of the linear-motion drive roller, and in the case where the sheet is aligned in the right direction, the control unit may cause the right-skew drive roller to rotate such that a component of velocity of the right-skew drive roller in the transport direction is identical to the velocity of rotation of the linear-motion drive roller.

A sheet processing apparatus according to the present disclosure is a sheet processing apparatus comprising an aligner that transports a sheet on a transport path. The aligner comprises: the transport path; a linear-motion transport unit that generates a drive force to the sheet on the transport path, where the drive force is a drive force in a transport direction along the transport path; a left-skew transport unit that is disposed in a left direction with respect to the transport direction of the linear-motion transport unit and generates a drive force to the sheet on the transport path, where the drive force is a drive force in a left-oblique direction inclined in the left direction; and a right-skew transport unit that is disposed in a right direction with respect to the transport direction of the linear-motion transport unit and generates a drive force to the sheet on the transport path, where the drive force is a drive force in a right-oblique direction inclined in the right direction.

The sheet processing apparatus according to the present disclosure may further comprise: a control unit that controls the linear-motion transport unit, the left-skew transport unit, and the right-skew transport unit such that the sheet is transported while being selectively aligned leftward or rightward in the transport direction; and a recognition unit that recognizes a position of the sheet, and the control unit may control the linear-motion transport unit, the left-skew transport unit, and the right-skew transport unit based on a recognition result of the recognition unit.

The sheet processing apparatus according to the present disclosure may further comprise a recognition unit that recognizes a position of the sheet in a left-right direction, and the aligner may determine an aligning amount in the left direction or the right direction based on a recognition result of the recognition unit.

In the sheet processing apparatus according to the present disclosure, the linear-motion transport unit, the left-skew transport unit, and the right-skew transport unit each may comprise a linear-motion drive roller, a left-skew drive roller, and a right-skew drive roller that are disposed on a side of one main surface of the sheet, and the control unit may cause, based on the recognition result of the recognition unit, the right-skew drive roller or the left-skew drive roller to come into contact with the sheet and to rotate.

In the sheet processing apparatus according to the present disclosure, the control unit may change, based on the recognition result of the recognition unit, a time when the control unit causes the right-skew drive roller or the left-skew drive roller to come into contact with the sheet.

The sheet processing apparatus according to the present disclosure may further comprise a collection unit that collects the sheet. In a case where the sheet is transported to the collection unit, the control unit may control the linear-motion transport unit, the left-skew transport unit, and the right-skew transport unit such that the sheet is transported while being aligned leftward or rightward in the transport direction.

In the sheet processing apparatus according to the present disclosure, the collection unit may stack the sheet in an upright state and in a horizontal direction and store the sheet.

A sheet width alignment method according to the present disclosure is a sheet width alignment method to be executed by an aligner that transports a sheet on a transport path. The sheet width alignment method comprises transporting, by the aligner, a plurality of the sheets while selectively aligning the plurality of sheets leftward or rightward in a transport direction of the sheet for each predetermined number of one or the plurality of sheets. The predetermined number may be settable by an operation of a user.

In the sheet width alignment method according to the present disclosure, in the transporting, the aligner may selectively perform width alignment transport processing or linear-motion transport processing based on a transport destination of the plurality of sheets, where the width alignment transport processing is processing of transporting the plurality of sheets while aligning the plurality of sheets in the left direction or the right direction for the each predetermined number of the one or plurality of sheets, and the linear-motion transport processing is processing of transporting the plurality of sheets without aligning the plurality of sheets in the left direction or the right direction. It may be settable by an operation of the user whether the width alignment transport processing or the linear-motion transport processing is performed. It may also be settable which transport processing is executed for each transport destination.

In the sheet width alignment method according to the present disclosure, the aligner may perform the width alignment transport processing in a case where the transport destination is a collection unit that collects the sheet. The collection unit may be configured to store the sheets in an upright state and in a horizontal direction. The collection unit may be a storage bag.

In the sheet width alignment method according to the present disclosure, the aligner may perform the linear-motion transport processing in a case where the transport destination is a recycle storage unit that stores a sheet to be recycled.

The aligner, the sheet processing apparatus, and the sheet width alignment method according to the present disclosure are capable of aligning a sheet during transport in a direction orthogonal to a transport direction.

Embodiment 1

Embodiment 1 will be described with reference to the accompanying drawings.

<Configuration of Aligner>

First, a configuration of an aligner will be described. FIG. 1 is a schematic diagram illustrating a state of the aligner viewed from above. Note that, the left direction and the right direction in Embodiments 1 and 2 are the left direction and the right direction when a banknote during transport is viewed from the rear side, respectively.

An aligner 1 indicated in FIG. 1 is an exemplary aligner of the present disclosure and is an apparatus that performs width alignment of a sheet, for example, a banknote. The object to be transported by the aligner 1 is a banknote P which is an example of the sheet of the present disclosure. The aligner 1 comprises a transport path 11, a linear-motion transport unit 12, a left-skew transport unit 13, and a right-skew transport unit 14.

The transport path 11 transports the banknote P. The transport path 11 is formed of a combination of rollers (not illustrated), a belt (not illustrated) wound around the rollers, motors (not illustrated) that drive the rollers, side walls (not illustrated), and the like.

The linear-motion transport unit 12 generates a drive force in a transport direction D1 along the transport path 11 to the banknote P on the transport path 11.

The left-skew transport unit 13 is disposed on the left side of the linear-motion transport unit 12. The left-skew transport unit 13 generates a drive force in a left-oblique direction D2, which is inclined to the left side with respect to the transport direction D1, to the banknote P on the transport path 11.

The right-skew transport unit 14 is disposed on the right side of the linear-motion transport unit 12. The right-skew transport unit 14 generates a drive force in a right-oblique direction D3, which is inclined to the right side with respect to the transport direction D1, to the banknote P on the transport path 11.

Note that, although FIG. 1 illustrates one linear-motion transport unit 12, one left-skew transport unit 13, and one right-skew transport unit 14, at least one of a plurality of the linear-motion transport units 12, a plurality of the left-skew transport units 13, and a plurality of the right-skew transport units 14 may be disposed as long as the disposition relationship described above is satisfied.

<Operation of Aligner>

Figure 2A:
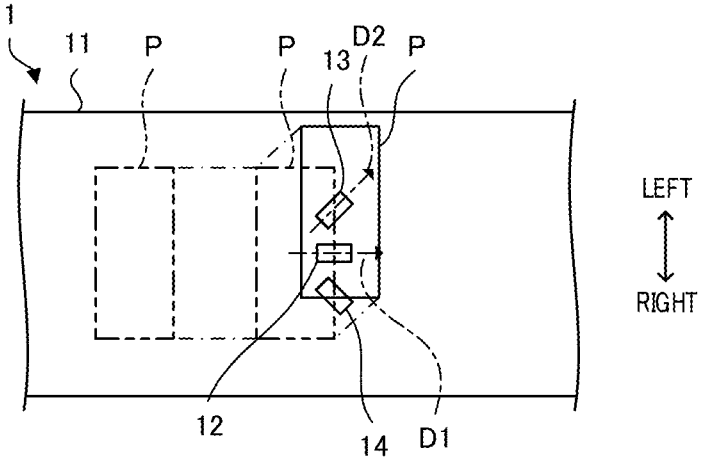
FIG. 2A is a diagram provided for describing an operation of the aligner in a case where a banknote is aligned in the left direction in Embodiment 1.
Figure 2B:
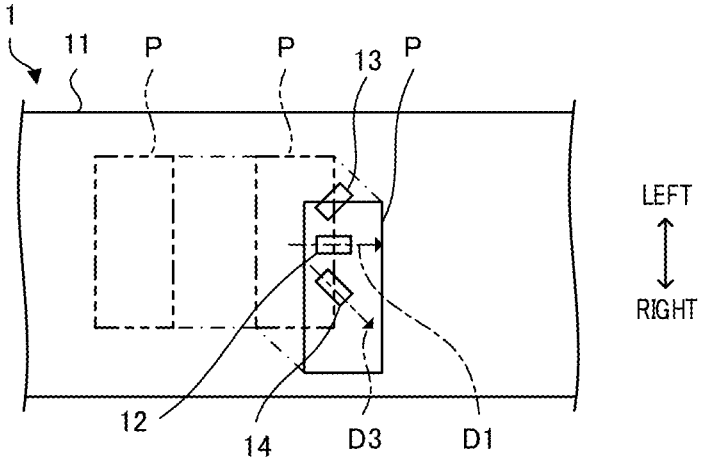
FIG. 2B is a diagram provided for describing an operation of the aligner in a case where a banknote is aligned in the right direction in Embodiment 1.

Next, an operation of the aligner 1 will be described. FIG. 2A is a diagram provided for describing an operation of the aligner in a case where a banknote is aligned (shifted) in the left direction. FIG. 2B is a diagram provided for describing an operation of the aligner in a case where a banknote is aligned in the right direction.

First, in a case where the banknote P is aligned in the left direction as illustrated in FIG. 2A, the linear-motion transport unit 12 and the left-skew transport unit 13 give drive forces in the transport direction D1 and the left-oblique direction D2, respectively, to the banknote P in a state of being in contact with at least the linear-motion transport unit 12 and the left-skew transport unit 13, where the banknote P is being transported in the transport direction D1 by a drive of a transport mechanism (not illustrated). The right-skew transport unit 14, on the other hand, does not give a drive force in the right-oblique direction D3 to the banknote P. By such operations of the linear-motion transport unit 12, the left-skew transport unit 13, and the right-skew transport unit 14, the banknote P is aligned in the left direction on the transport path 11 as indicated with the long dashed short dashed lines.

In a case where the banknote P is aligned in the right direction as illustrated in FIG. 2B, on the other hand, the linear-motion transport unit 12 and the right-skew transport unit 14 give drive forces in the transport direction D1 and the right-oblique direction D3, respectively, to the banknote P in a state of being in contact with at least the linear-motion transport unit 12 and the right-skew transport unit 14, where the banknote P is being transported in the transport direction D1. The left-skew transport unit 13, on the other hand, does not give a drive force in the left-oblique direction D2 to the banknote P. By such operations of the linear-motion transport unit 12, the left-skew transport unit 13, and the right-skew transport unit 14, the banknote P is aligned in the right direction on the transport path 11 as indicated with the long dashed short dashed lines.

As described above, the aligner 1 is capable of selectively aligning the banknote P on the transport path 11 in the left direction or the right direction, that is, in a direction orthogonal to the transport direction. In particular, since the linear-motion transport unit 12 is disposed between the left-skew transport unit 13 and the right-skew transport unit 14, it is possible to increase an aligning amount of the banknote P in the left direction or the right direction in comparison with, for example, a configuration in which the left-skew transport unit 13 and the right-skew transport unit 14 are disposed between two linear-motion transport units 12.

Embodiment 2

Next, Embodiment 2 will be described with reference to the accompanying drawings.

<Configuration of Aligner>

Figure 3A:
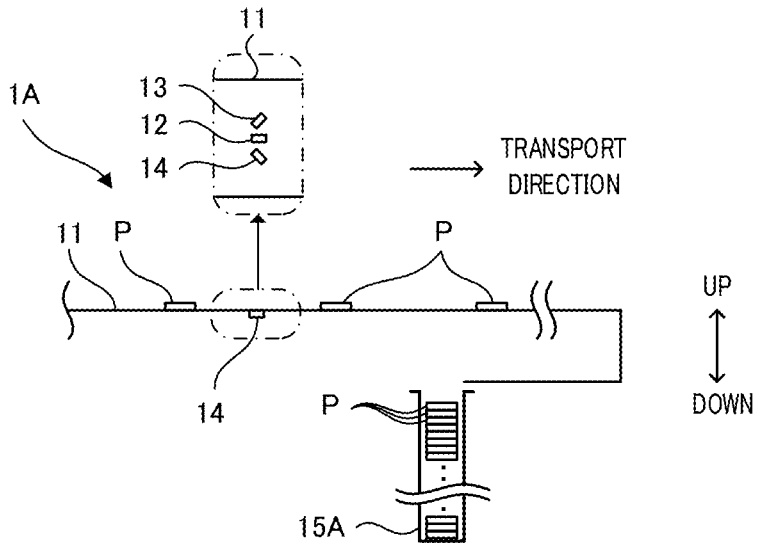
FIG. 3A is a schematic diagram illustrating a state of an aligner viewed from the right side in Embodiment 2.
Figure 3B:
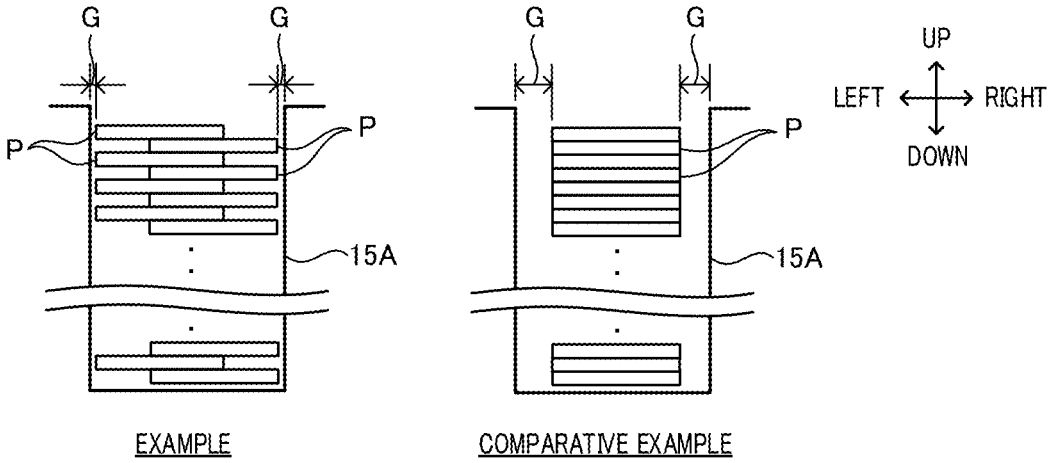
FIG. 3B is a schematic diagram illustrating states of the insides of storage units stored with banknotes viewed from the front side in an Example and a Comparative Example in Embodiment 2.
Figure 3C:
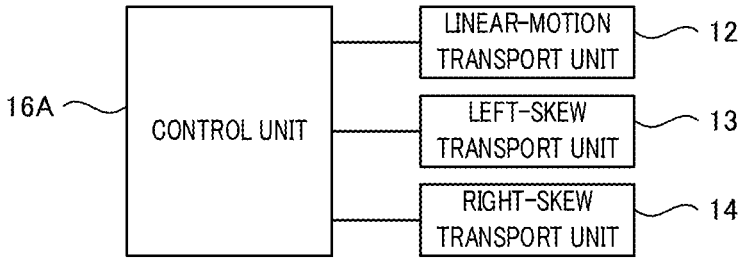
FIG. 3C is a block diagram illustrating a configuration of a control system of the aligner in Embodiment 2.

First, a configuration of an aligner will be described. FIG. 3A is a schematic diagram illustrating a state of the aligner viewed from the right side. FIG. 3B is a schematic diagram illustrating states of the insides of storage units stored with banknotes viewed from the front side in an Example and a Comparative Example. FIG. 3C is a block diagram illustrating a configuration of a control system of the aligner. Note that, the same configurations as in Embodiment 1 will be denoted by the same reference signs and the same names, and descriptions thereof will be omitted as appropriate.

An aligner 1A indicated in FIG. 3A comprises the transport path 11, the linear-motion transport unit 12, the left-skew transport unit 13, the right-skew transport unit 14, a storage unit 15A, and a control unit (not shown).

The storage unit 15A stores the banknote P transported by the transport path 11. As in the drawing on the left side indicated as the Example in FIG. 3B, the storage unit 15A is configured to be capable of storing, in a stacking manner, a plurality of the banknotes P selectively aligned in the left direction or the right direction for each predetermined number of one or the plurality of banknotes P. The storage unit 15A is formed of, for example, a storage bag.

The control unit 16A is configured to be capable of controlling the linear-motion transport unit 12, the left-skew transport unit 13, and the right-skew transport unit 14 as illustrated in FIG. 3C, and the motors that drive the rollers of the transport path 11. The control unit 16A controls the linear-motion transport unit 12, the left-skew transport unit 13, and the right-skew transport unit 14 such that a plurality of the banknotes P on the transport path 11 is selectively aligned in the left direction or the right direction for each predetermined number of one or the plurality of banknotes P.

<Operation of Aligner>

Next, an operation of the aligner 1A will be described.

The control unit 16A controls the linear-motion transport unit 12, the left-skew transport unit 13, and the right-skew transport unit 14 such that the banknotes P on the transport path 11 are selectively aligned one by one in the left direction or the right direction. When the banknotes P are aligned in the left direction or the right direction, the control unit 16A controls the linear-motion transport unit 12, the left-skew transport unit 13, and the right-skew transport unit 14 in the same manner as in the operation exemplified in Embodiment 1. As indicated as the Example in FIG. 3B, the banknotes P aligned in the left direction or the right direction by the control of the control unit 16A are stored in a state of being aligned in the left direction or the right direction in the storage unit 15A. Note that, although a case where the banknotes P are selectively aligned one by one in the left direction or the right direction has been exemplified in Embodiment 2, the banknotes P may be selectively aligned in the left direction or the right direction for each plurality of the banknotes P.

Here, in a case where the banknotes P are aligned in neither the left direction nor the right direction as in the drawing on the right side indicated as the Comparative Example in FIG. 3B or in a case where the banknotes P are aligned in only the left direction or the right direction, a gap G between an end part on the left side or the right side of a bundle of the banknotes P and the inner surface of the storage unit 15A increases. For this reason, the bundle of the banknotes P may collapse in the storage unit 15A while the banknotes P are being to be stored or while the storage unit 15A is being carried. In Embodiment 2, on the other hand, the aligner 1A selectively aligns a plurality of the banknotes P on the transport path 11 in the left direction or the right direction for each predetermined number of one or the plurality of banknotes P as indicated as the Example in FIG. 3B. For this reason, the gap G between the end part on the left side or the right side of the bundle of the banknotes P and the inner surface of the storage unit 15A can be reduced and it is possible to restrain the bundle of the banknotes P from collapsing in the storage unit 15A while the banknotes P are being to be stored or while the storage unit 15A is being carried.

Embodiment 3

Next, Embodiment 3 will be described with reference to the accompanying drawings.

<Configuration of Banknote Processing Apparatus>

Figure 4:
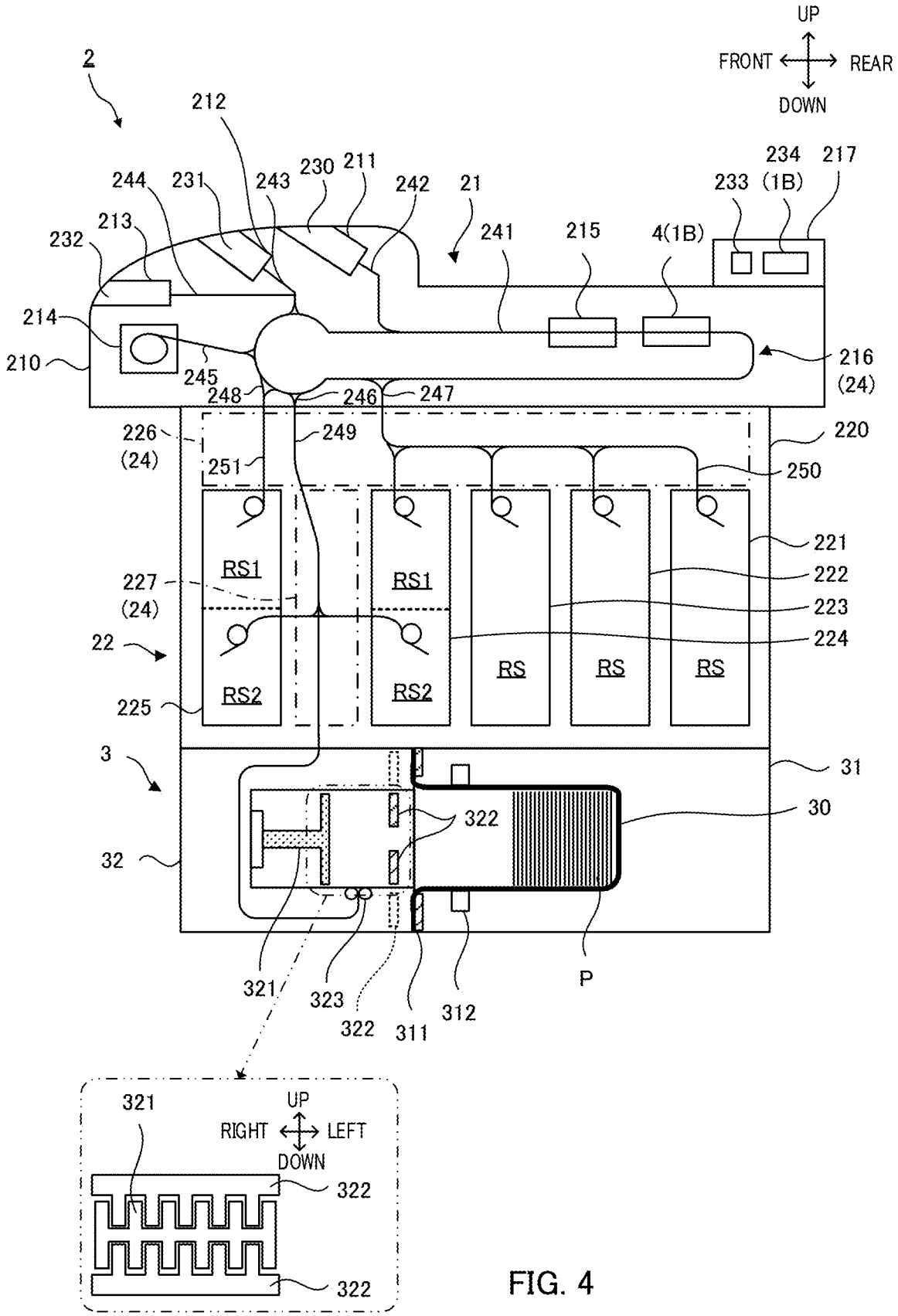
FIG. 4 is a schematic diagram illustrating a schematic configuration of a banknote processing apparatus in Embodiment 3.

First, a configuration of a banknote processing apparatus will be described. FIG. 4 is a schematic diagram illustrating a schematic configuration of the banknote processing apparatus. Note that, hereinafter, the front side refers to a side on which the user of the banknote processing apparatus faces the banknote processing apparatus, and the rear side refers to the side opposite to the front side. Further, the right side refers to the right side viewed from the user, and the left side refers to the side opposite to the right side. The upper side refers to the upper side in a case where the banknote processing apparatus has been installed on a horizontal surface, and the lower side refers to the side opposite to the upper side.

A banknote processing apparatus 2 indicated in FIG. 4 is an example of the sheet processing apparatus of the present disclosure. The banknote processing apparatus 2 is installed in, for example, a back office of a financial institution such as a bank. Note that, the banknote processing apparatus 2 may also be installed in a back office of a store such as a retail store. The banknote processing apparatus 2 comprises a processing unit 21 in the upper part and a safe unit 22 in the lower part. The processing unit 21 comprises an upper housing 210, and comprises a depositing unit 211, a dispensing unit 212, a reject unit 213, a temporary storage unit 214, a recognition unit 215, an upper-side transport unit 216, a terminal computer 217, and an aligner 1B which are disposed inside the upper housing 210.

The safe unit 22 is configured to comprise a safe housing 220, to comprise a plurality of storage apparatuses 221 to 225, a lower-side transport unit 226, and a second lower-side transport unit 227 which are housed in the safe housing 220 described above, and to comprise a collection unit 3.

The depositing unit 211 is a part into which the banknote P to be deposited (for example, see FIG. 5A) is inputted at the time of depositing processing, for example. The depositing unit 211 may also be a part into which the banknote P to be counted is inputted at the time of counting processing. The depositing unit 211 comprises an inlet 230. The inlet 230 is open upward in the front part of the upper housing 210. The user inputs the banknote P through the inlet 230 into the depositing unit 211 by hand. The depositing unit 211 comprises a mechanism to feed the banknotes P one by one into the banknote processing apparatus 2.

The dispensing unit 212 is a part to which the banknote P fed out from the storage apparatuses 221 to 225 is transported at the time of dispensing processing, for example. Further, the dispensing unit 212 is also used as a part to which a reject banknote P generated at the time of the depositing processing is transported. Further, the dispensing unit 212 is also used as a part to which a normal banknote P counted at the time of the counting processing is transported. The dispensing unit 212 is capable of holding a plurality of the banknotes P in a stacked state. The dispensing unit 212 comprises an outlet 231. The outlet 231 is open upward at a position frontward from the inlet 230. The user can take out the banknotes P stacked in the dispensing unit 212 by hand through the outlet 231.

The reject unit 213 is a part to which a reject banknote generated at the time of the counting processing is transported, for example. The reject unit 213 is disposed in the front part in the upper housing 210. The reject unit 213 is configured to hold a plurality of the banknotes P in a stacked state. The reject unit 213 comprises a second outlet 232. The second outlet 232 opens forward in the front part of the upper housing 210.

The temporary storage unit 214 temporarily stores the banknote P to be deposited at the time of the depositing processing, for example. The temporary storage unit 214 is capable of feeding out the banknote P that has been stored. The temporary storage unit 214 is a tape-type storage unit. The temporary storage unit 214 stores the banknote P by winding the banknote P together with a tape on a drum.

The recognition unit 215 is disposed in a first transport path 241 to be described later in the upper-side transport unit 216. The recognition unit 215 uses a well-known method to recognize the denomination and fitness of the banknote P. The recognition unit 215 transmits an authentication determination result and a recognition result of the denomination and fitness to the terminal computer 217. The recognition unit 215 detects the inclination (attitude) of the banknote P with respect to the front-rear direction (transport direction), the size of the banknote P, and the position of the banknote P in the width direction of the transport path, and transmits a detection result to the terminal computer 217.

The terminal computer 217 comprises a memory unit 233 and a control unit 234.

The memory unit 233 stores a program that is executed by the terminal computer 217.

The control unit 234 integrally controls the banknote processing apparatus 2. Specific processing of the control unit 234 will be described later.

The aligner 1B is formed of a width alignment mechanism 4 and the control unit 234 described above. The width alignment mechanism 4 is disposed downstream of the transport direction of the banknote P at the time of depositing with respect to the recognition unit 215 in the first transport path 241. The width alignment mechanism 4 selectively aligns the banknote P in the left direction or the right direction. Note that, a specific configuration of the width alignment mechanism 4 will be described later.

In the safe unit 22, the lower-side transport unit 226, the second lower-side transport unit 227, the five storage apparatuses 221 to 225, and the collection unit 3 are disposed.

The five storage apparatuses 221 to 225 are each formed of a stacking-type storage cassette that stacks and stores the banknotes P. In the following description, these five storage apparatuses may also be referred to as a first storage apparatus 221, a second storage apparatus 222, a third storage apparatus 223, a fourth storage apparatus 224, and a fifth storage apparatus 225.

Each of the first storage apparatus 221, the second storage apparatus 222, and the third storage apparatus 223 comprises one recycle storage unit RS. Each of the fourth storage apparatus 224 and the fifth storage apparatus 225 comprises two recycle storage units (a first recycle storage unit RS1 and a second recycle storage unit RS2).

Each of the recycle storage units RS, each of the first recycle storage units RS1, and each of the second recycle storage units RS2 store a banknote P to be recycled. Denominations of the banknotes P to be stored in each of the recycle storage unit RS, each of the first recycle storage units RS1, and each of the second recycle storage units RS2 are set in advance. Each of the recycle storage units RS, each of the first recycle storage units RS1, and each of the second recycle storage units RS2 comprise a transport mechanism. The transport mechanism is configured such that the banknote P can be recycled by inputting the banknote P into the storage apparatuses 221 to 225 from outside and feeding out the banknote P from the storage apparatuses 221 to 225 outside.

The collection unit 3 is a part to which a banknote P to be collected is transported at the time of the depositing processing, for example. The banknote P to be collected is, for example, a high-value money of a fit note or an unfit note. The collection unit 3 comprises an attachment unit 31 and a movement unit 32.

The attachment unit 31 is a unit to which a storage bag 30 is attached. The movement unit 32 is a unit that moves the banknote P, which has been transported by the second lower-side transport unit 227, in an upright state (a state in which the perpendicular to the main surface of the banknote P is substantially parallel to the horizontal direction) as is and horizontally rearward and stores the banknote P inside the storage bag 30.

The attachment unit 31 comprises an attachment section 311 and a sealing unit 312. An entrance part of the storage bag 30 is attached to the attachment section 311. A body part other than the entrance part of the storage bag 30 is disposed so as to extend rearward from the entrance part attached to the attachment section 311. The sealing unit 312 seals a predetermined part of the storage bag 30 by holding the predetermined part from outside. A known method can be employed as a method for the sealing unit 312 to seal the storage bag 30. The upper surface of the attachment unit 31 is provided with an opening. This opening is provided with a lid (not illustrated) that can be opened and closed. The attachment unit 31 is configured so as to be drawable rearward by a slide unit (not illustrated).

The movement unit 32 comprises a compression unit 321, a regulation unit 322, and a feeding unit 323. The movement unit 32 is disposed on the front side of the attachment unit 31.

The regulation unit 322 is provided near the border between the movement unit 32 and the attachment unit 31 and regulates movement of the banknote P inside the movement unit 32 into the storage bag 30. When the movement of the banknote P to the storage bag 30 by the compression unit 321 does not occur, the regulation unit 322 prevents the banknote P from unintentionally entering the storage bag 30 by regulating the movement of the banknote P. Further, the regulation unit 322 releases the regulation when the movement of the banknote P to the storage bag 30 by the compression unit 321 occurs. The regulation unit 322 comprises a structure divided into an upper-side portion and a lower-side portion. The upper-side portion of the regulation unit 322 is configured to be capable of moving upward, and the lower-side portion of the regulation unit 322 is configured to be capable of moving downward. FIG. 4 indicates the position of the regulation unit 322 in a closed state with the solid lines and the position of the regulation unit 322 in an open state with the dashed line, respectively.

Next, the compression unit 321 and the regulation unit 322 will be described in detail. As indicated in the partially enlarged view surrounded by the frame of the two-dot chain line in FIG. 4, the rear end part of the compression unit 321 is formed in a grid shape. Further, each of the upper-side portion and the lower-side portion into which the regulation unit 322 is divided is formed in a comb-tooth shape. Such a configuration enables the regulation unit 322 to regulate rearward movement of the banknote P in the closed state, and also enables the leading-end parts of the compression unit 321 to pass through the gaps of the comb-tooth shape. Further, the regulation unit 322 is capable not of regulating the rearward movement of the banknote P in the open state.

The feeding unit 323 feeds out the banknote P transported by the second lower-side transport unit 227 into the movement unit 32. The feeding unit 323 comprises, for example, a blade that rotates, and is configured to feed out the banknote P rearward in the movement unit 32. Thus, the banknote P fed out by the feeding unit 323 is stacked in an upright state on the front side of the regulation unit 322 in the closed state.

The upper-side transport unit 216, the lower-side transport unit 226, and the second lower-side transport unit 227 form a transport unit 24. The transport unit 24 transports the banknotes P one by one with an appropriate distance between the banknotes Pin the banknote processing apparatus 2.

The upper-side transport unit 216 comprises the first transport path 241, a second transport path 242, a third transport path 243, a fourth transport path 244, a fifth transport path 245, a sixth transport path 246, a seventh transport path 247, and an eighth transport path 248. The first transport path 241 is formed in a loop shape. The transport unit 24 is capable of transporting the banknote P along the first transport path 241 in each of clockwise and counterclockwise directions in FIG. 4. The second transport path 242 connects the depositing unit 211 and the first transport path 241. The third transport path 243 connects the dispensing unit 212 and the first transport path 241. The fourth transport path 244 connects the reject unit 213 and the first transport path 241. The fifth transport path 245 connects the temporary storage unit 214 and the first transport path 241. Each of the sixth transport path 246, the seventh transport path 247, and the eighth transport path 248 connects the first transport path 241 and the lower-side transport unit 226.

The lower-side transport unit 226 comprises a ninth transport path 249, a tenth transport path 250, and an eleventh transport path 251. The ninth transport path 249 connects the sixth transport path 246 and the second lower-side transport unit 227. The tenth transport path 250 connects the seventh transport path 247 and the respective recycle storage units RS of the first storage apparatus 221, the second storage apparatus 222 and the third storage apparatus 223 as well as the first recycle storage unit RS1 of the fourth storage apparatus 224. The eleventh transport path 251 connects the eighth transport path 248 and the first recycle storage unit RS1 of the fifth storage apparatus 225.

The second lower-side transport unit 227 is diverged halfway and is connected to the second recycle storage unit RS2 of the fourth storage apparatus 224, the second recycle storage unit RS2 of the fifth storage apparatus 225, and the collection unit 3. The second lower-side transport unit 227 transports the banknote P between the first transport path 241 and the second recycle storage unit RS2 of the fourth storage apparatus 224. Further, the second lower-side transport unit 227 transports the banknote P between the first transport path 241 and the second recycle storage unit RS2 of the fifth storage apparatus 225. The second lower-side transport unit 227 transports the banknote P from the first transport path 241 toward the collection unit 3.

In each part of the transport unit 24, tracking sensors (illustrations thereof will be omitted) that detect the passage of the banknote P are disposed. Upon receiving a command from the terminal computer 217, the transport unit 24 transports the banknote P to a predetermined transport destination based on detection signals of the tracking sensors.

Figure 5A:
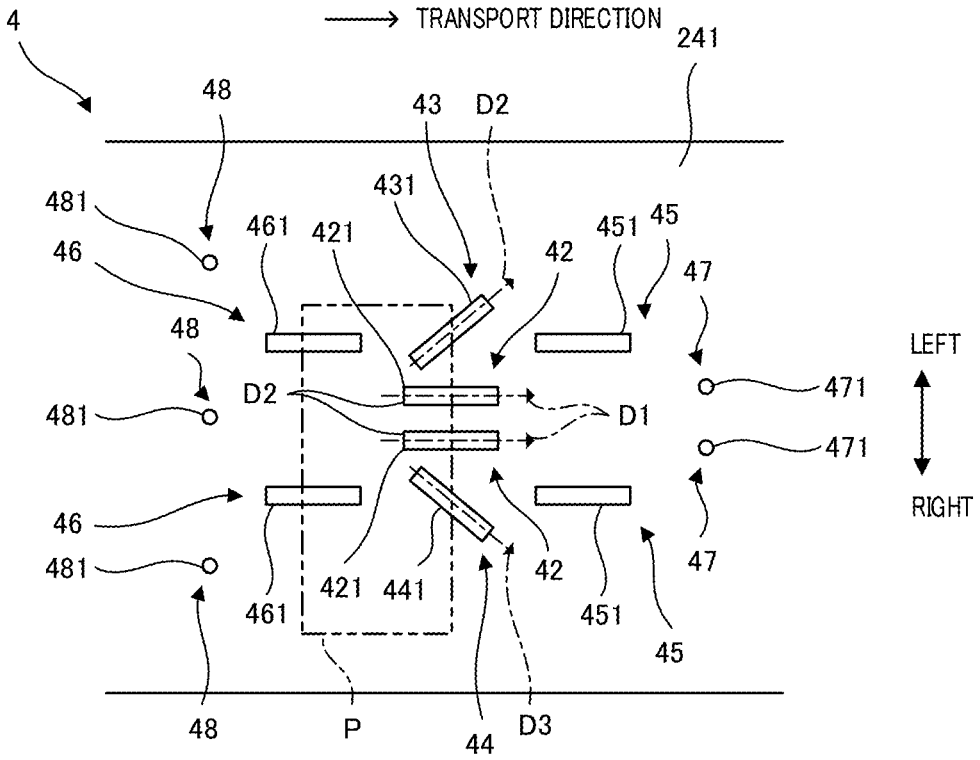
FIG. 5A is a plane view of a width alignment mechanism in Embodiment 3.
Figure 5B:
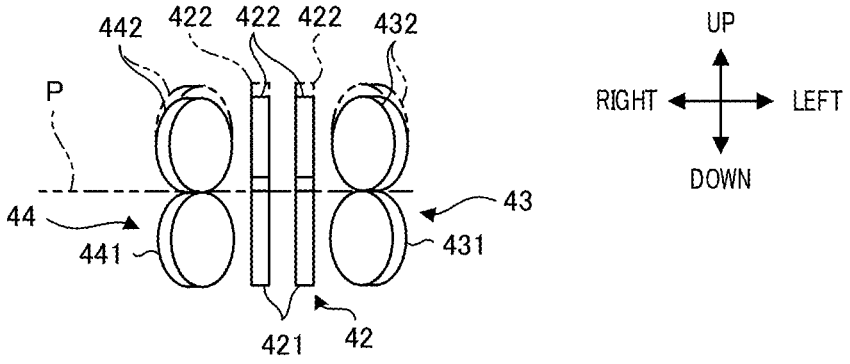
FIG. 5B is a diagram of linear-motion transport units, a left-skew transport unit, and a right-skew transport unit viewed from the rear side in Embodiment 3.
Figure 5C:
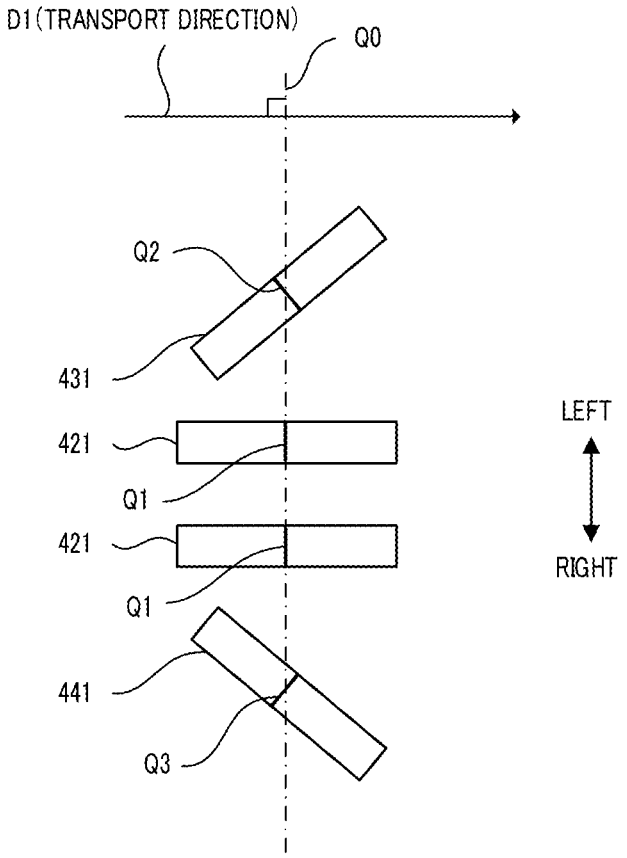
FIG. 5C is a plane view of a linear-motion drive roller, a left-skew drive roller, and a right-skew drive roller in Embodiment 3.
Figure 5D:
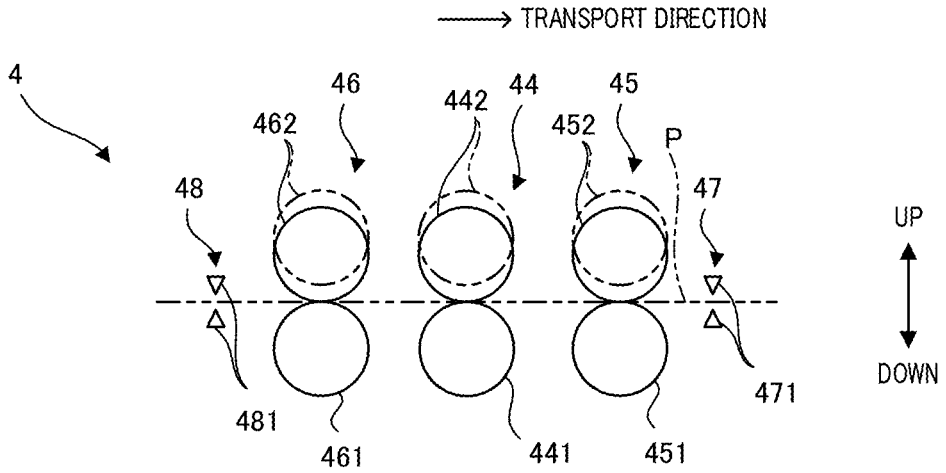
FIG. 5D is a side view of the width alignment mechanism in Embodiment 3.

Next, a detailed configuration of the width alignment mechanism 4 will be described. FIG. 5A is a plane view of the width alignment mechanism. FIG. 5B is a diagram of linear-motion transport units, a left-skew transport unit, and a right-skew transport unit viewed from the rear side. FIG. 5C is a plane view of a linear-motion drive roller, a left-skew drive roller, and a right-skew drive roller. FIG. 5D is a side view of the width alignment mechanism.

The width alignment mechanism 4 indicated in FIG. 5A comprises the first transport path 241 described above, two linear-motion transport units 42, a left-skew transport unit 43, a right-skew transport unit 44, two frontward linear-motion transport units 45, two rearward linear-motion transport units 46, two sets of frontward tracking sensors 47, and three sets of rearward tracking sensors 48. Note that, the numbers of the respective transport units 42, 43, 44, 45, and 46 are not limited to the numbers described above.

Each of the linear-motion transport units 42 gives a drive force in the transport direction D1 along the first transport path 241 to the banknote P on the first transport path 241. The left-skew transport unit 43 gives a drive force in the left-oblique direction D2, which is inclined in the left direction with respect to the transport direction D1, to the banknote P on the first transport path 241. The right-skew transport unit 44 gives a drive force in the right-oblique direction D3, which is inclined in the right direction with respect to the transport direction D1, to the banknote P on the first transport path 241. Thus, disposing the linear-motion transport units 42 between the left-skew transport unit 43 and the right-skew transport unit 44 makes it possible to increase an aligning amount of the banknote P in the left direction or the right direction in comparison with a configuration in which the left-skew transport unit 43 and the right-skew transport unit 44 are disposed between the two linear-motion transport units 42.

As illustrated in FIG. 5B, each of the linear-motion transport units 42 comprises a linear-motion drive roller 421 and a linear-motion driven roller 422. The linear-motion drive roller 421 and the linear-motion driven roller 422 are examples of the linear-motion roller of the present disclosure and rotate around an axis of rotation orthogonal to the transport direction D1. The left-skew transport unit 43 comprises a left-skew drive roller 431 and a left-skew driven roller 432. The left-skew drive roller 431 and the left-skew driven roller 432 are examples of the left-skew roller of the present disclosure and rotate around an axis of rotation orthogonal to the left-oblique direction D2. The right-skew transport unit 44 comprises a right-skew drive roller 441 and a right-skew driven roller 442. The right-skew drive roller 441 and the right-skew driven roller 442 are examples of the right-skew roller of the present disclosure and rotate around an axis of rotation orthogonal to the right-oblique direction D3. The linear-motion drive roller 421, the linear-motion driven roller 422, the left-skew drive roller 431, the left-skew driven roller 432, the right-skew drive roller 441, and the right-skew driven roller 442 are formed in the same shape. Note that, each of the rollers 421, 422, 431, 432, 441, and 442 may not be formed in the same shape.

The two linear-motion drive rollers 421, the left-skew drive roller 431, and the right-skew drive roller 441 are disposed so as to be arranged in a row in the width direction (left-right direction) of the first transport path 241 (hereinafter "the width direction of the first transport path 241" may also be referred to as "the width direction of the transport path"). The two linear-motion drive rollers 421 are disposed so as to be arranged in the left-right direction in the center in the width direction of the transport path. The left-skew drive roller 431 is disposed on the left side of the linear-motion drive roller 421 that is the left-side linear-motion drive roller. The right-skew drive roller 441 is disposed on the right side of the linear-motion drive roller 421 that is the right-side linear-motion drive roller. The linear-motion drive rollers 421, the left-skew drive roller 431, and the right-skew drive roller 441 rotate with the drives of motors (not illustrated), respectively, which differ from each other. The motors may be stepper motors or DC motors.

The two linear-motion driven rollers 422, the left-skew driven roller 432, and the right-skew driven roller 442 are disposed upward from the two linear-motion drive rollers 421, the left-skew drive roller 431, and the right-skew drive roller 441, respectively. Each of the driven rollers 422, 432, and 442 (the linear-motion driven rollers 422, the left-skew driven roller 432, and the right-skew driven roller 442) is disposed, together with each of the drive rollers 421, 431, and 441 (the linear-motion drive rollers 421, the left-skew drive roller 431, and the right-skew drive roller 441), so as to come into contact with the banknote P. The driven rollers 422, 432, and 442 are configured independently of each other to be switchable between the lowered positions indicated with the solid lines and the raised positions indicated with the two-dot chain lines in FIGS. 5B and 5D, respectively, by a raising-lowering mechanism (not illustrated). The lowered positions refer to positions at which the driven rollers 422, 432, and 442 come into contact with the banknote P, and the raised positions refer to positions at which the driven rollers 422, 432, and 442 do not come into contact with the banknote P.

As illustrated in FIG. 5C, contact positions Q1 at which each of the linear-motion drive rollers 421 and each of the linear-motion driven rollers 422 come into contact with the banknote P, a contact position Q2 at which the left-skew drive roller 431 and the left-skew driven roller 432 come into contact with the banknote P, and a contact position Q3 at which the right-skew drive roller 441 and the right-skew driven roller 442 come into contact with the banknote P are located on a reference line Q0 orthogonal to the transport direction D1 of the banknote P. That is, the linear-motion transport units 42, the left-skew transport unit 43, and the right-skew transport unit 44 are configured such that positions at which the drive forces are given to the banknote P are arranged in a row in the width direction of the transport path.

Each of the frontward linear-motion transport units 45 indicated in FIGS. 5A and 5D gives a drive force in the transport direction D1 to the banknote P on the first transport path 241 on the front side of the linear-motion transport units 42, the left-skew transport unit 43, and the right-skew transport unit 44 in the transport direction. Each of the rearward linear-motion transport units 46 gives a drive force in the transport direction D1 to the banknote P on the first transport path 241 on the rear side of the linear-motion transport units 42, the left-skew transport unit 43, and the right-skew transport unit 44 in the transport direction. Each of the frontward linear-motion transport units 45 comprises a frontward drive roller 451 and a frontward driven roller 452. Each of the rearward linear-motion transport units 46 comprises a rearward drive roller 461 and a rearward driven roller 462.

The two frontward drive rollers 451 are disposed so as to be arranged in a row in the width direction of the transport path. The two rearward drive rollers 461 are disposed so as to be arranged in a row in the width direction of the transport path. The frontward drive rollers 451 and the rearward drive rollers 461 rotate with the drives of motors (not illustrated), respectively, which differ from each other. The motors may be stepper motors or DC motors.

The two frontward driven rollers 452 and the two rearward driven rollers 462 are disposed upward from the two frontward drive rollers 451 and the two rearward drive rollers 461, respectively. Each of the driven rollers 452 and 462 (each of the frontward driven rollers 452 and each of the rearward driven rollers 462) is disposed, together with each of the drive rollers 451 and 461 (each of the frontward drive rollers 451 and each of the rearward drive rollers 461), so as to come into contact with the banknote P. The driven rollers 452 and 462 are configured independently of each other to be switchable between the lowered positions indicated with the solid lines and the raised positions indicated with the two-dot chain lines in FIG. 5D, respectively, by a raising-lowering mechanism (not illustrated). The lowered positions refer to positions at which the driven rollers 452 and 462 come into contact with the banknote P, and the raised positions refer to positions at which the driven rollers 452 and 462 do not come into contact with the banknote P.

Note that, hereinafter, a state in which the driven rollers 422, 432, 442, 452, and 462 are located at the lowered positions and the drive rollers 421, 431, 441, 451, and 461 are driven may also be referred to as a state in which the transport units 42, 43, 44, 45, and 46 (the linear-motion transport units 42, the left-skew transport unit 43, the right-skew transport unit 44, the frontward linear-motion transport units 45, and the rearward linear-motion transport units 46) are on. Further, a state in which the driven rollers 422, 432, 442, 452, and 462 are located at the raised positions and the drive rollers 421, 431, 441, 451, and 461 stop may also be referred to as a state in which the transport units 42, 43, 44, 45, and 46 are off.

The two sets of frontward tracking sensors 47 are disposed so as to be arranged in the width direction of the transport path on the front side of the frontward linear-motion transport units 45 in the transport direction. Each of the two sets of frontward tracking sensors 47 is formed of a pair of upper and lower sensors 471, and detects the passage of the banknote P transported between the pair of upper and lower sensors 471.

The three sets of rearward tracking sensor 48 are disposed so as to be arranged in the width direction of the transport path on the rear side of the rearward linear-motion transport units 46 in the transport direction. Each of the three sets of rearward tracking sensor 48 is formed of a pair of upper and lower sensors 481, and detects the passage of the banknote P transported between the pair of upper and lower sensors 481.

<Operation of Banknote Processing Apparatus>

Figure 6:
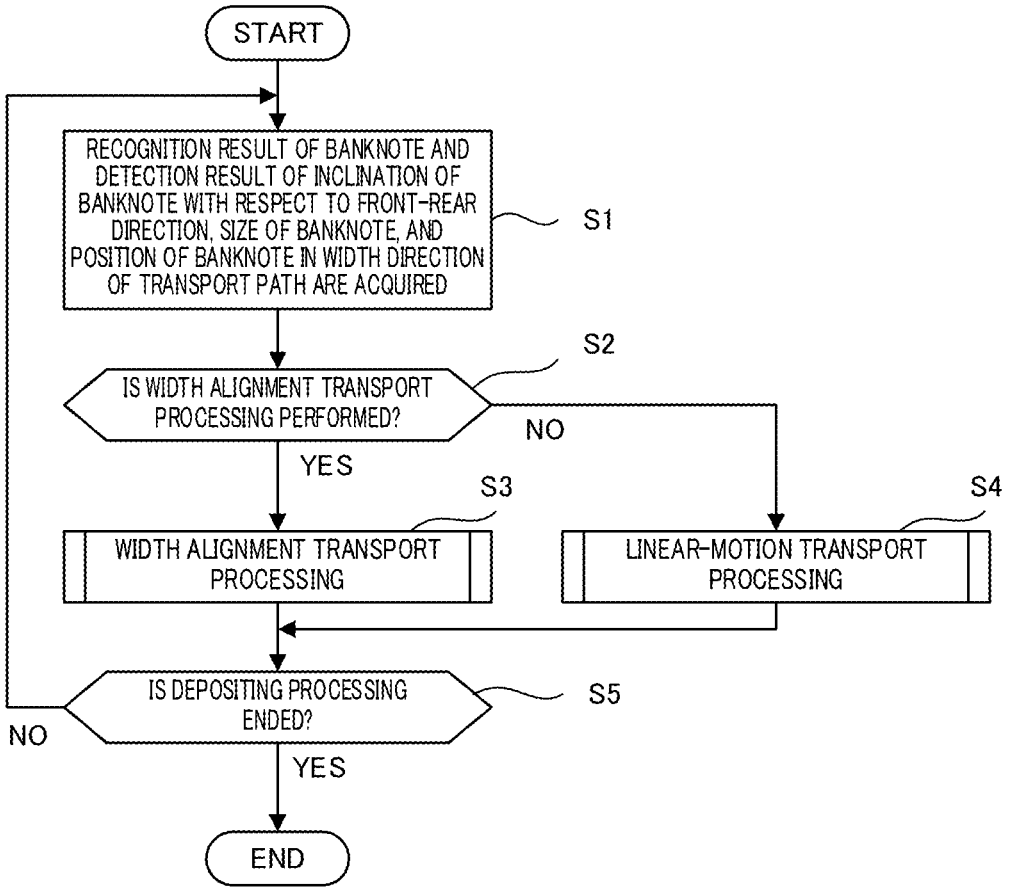
FIG. 6 is a flowchart for depositing processing in Embodiment 3.
Figure 7:
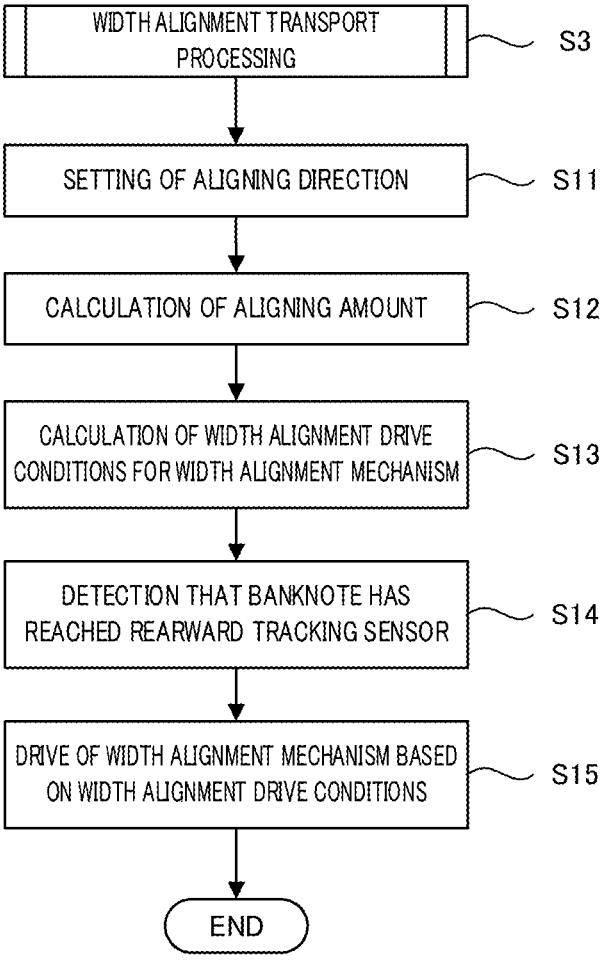
FIG. 7 is a flowchart for width alignment transport processing in Embodiment 3.
Figure 8A:
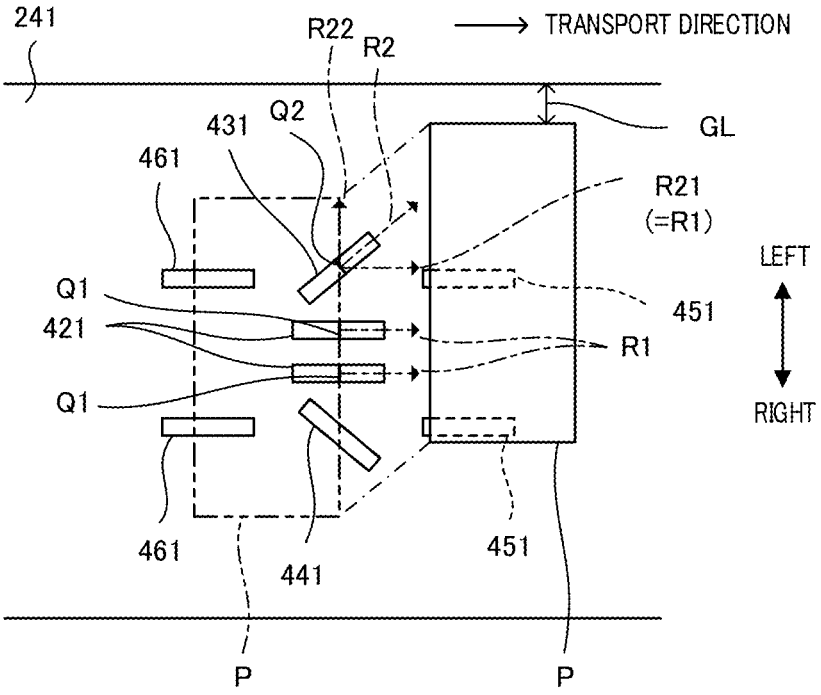
FIG. 8A is a diagram provided for describing an operation of the banknote processing apparatus in a case where a banknote is aligned in the left direction in Embodiment 3.
Figure 8B:
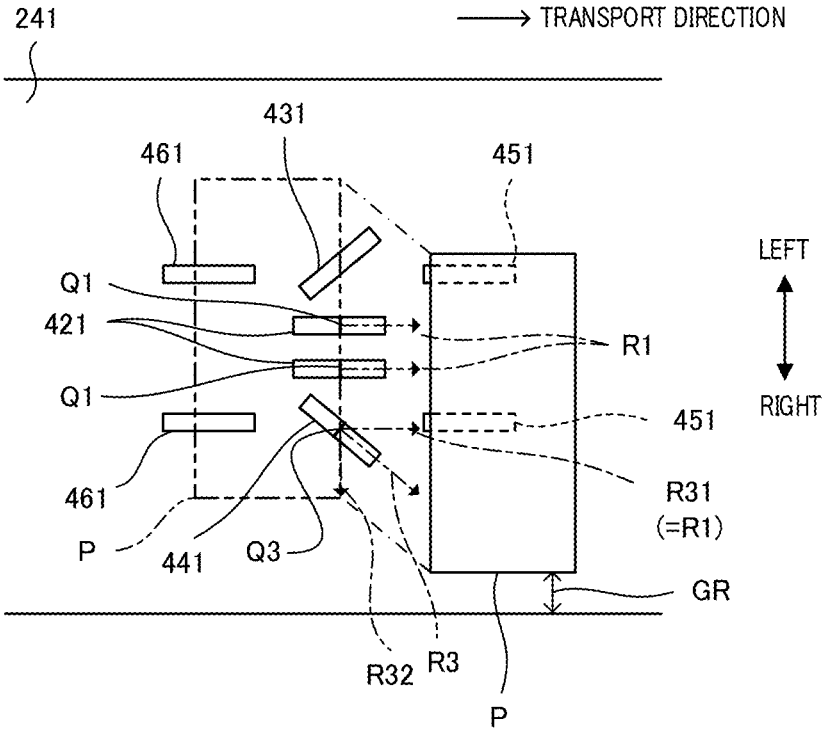
FIG. 8B is a diagram provided for describing an operation of the banknote processing apparatus in a case where a banknote is aligned in the right direction in Embodiment 3.
Figure 9A:
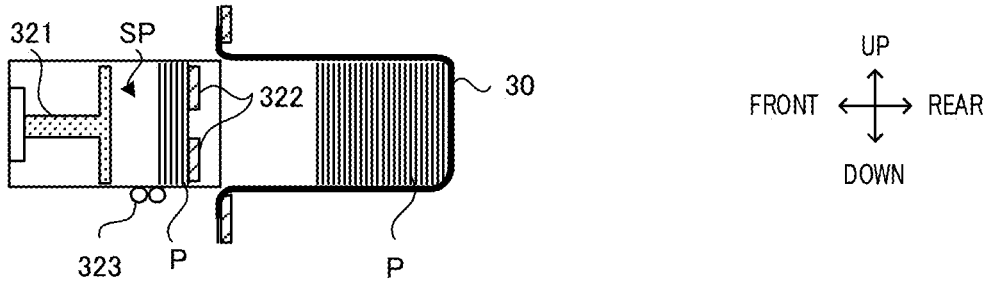
FIG. 9A is a diagram provided for describing an operation of a collection unit in Embodiment 3.
Figure 9B:
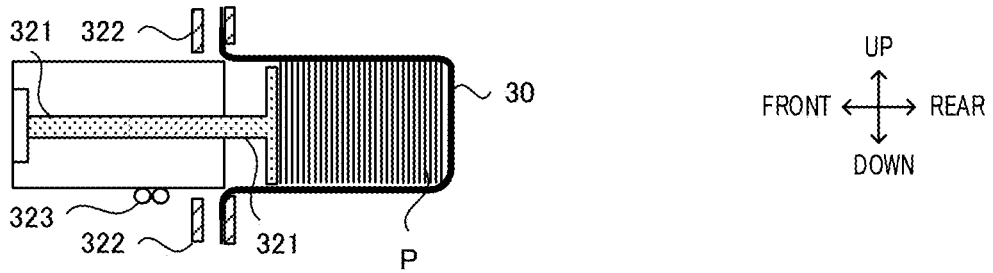
FIG. 9B is a diagram provided for describing an operation of the collection unit in Embodiment 3.
Figure 9C:
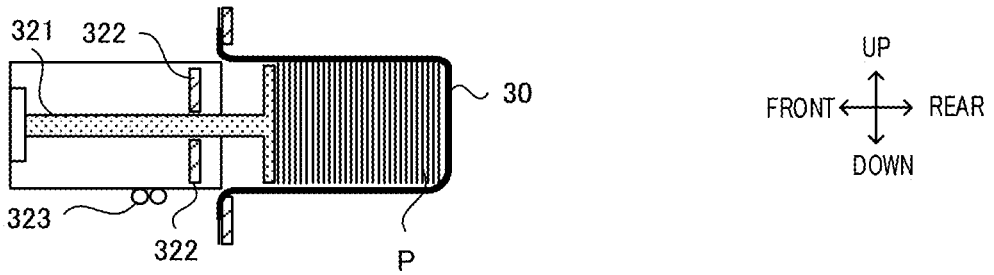
FIG. 9C is a diagram provided for describing an operation of the collection unit in Embodiment 3.
Figure 9D:
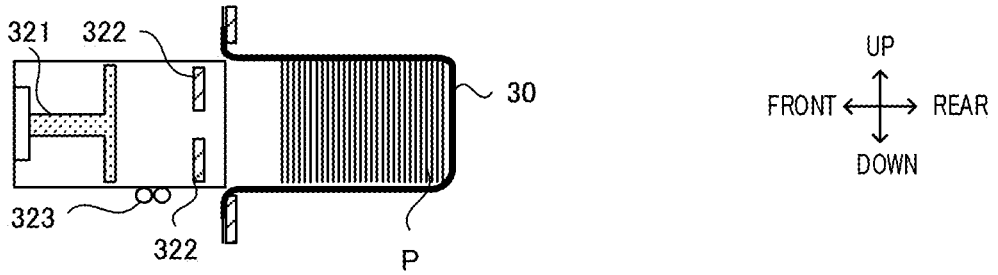
FIG. 9D is a diagram provided for describing an operation of the collection unit in Embodiment 3.
Figure 10A:
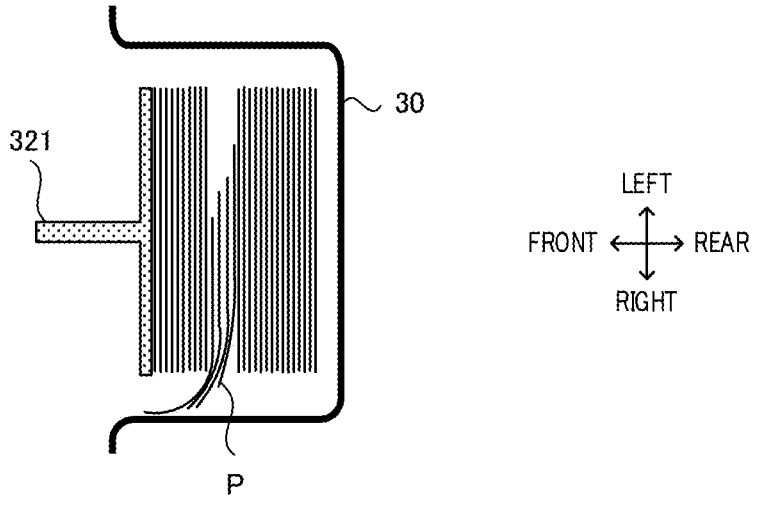
FIG. 10A is a schematic diagram illustrating a state in a case where banknotes have been transported to the collection unit by linear-motion transport processing in Embodiment 3.
Figure 10B:
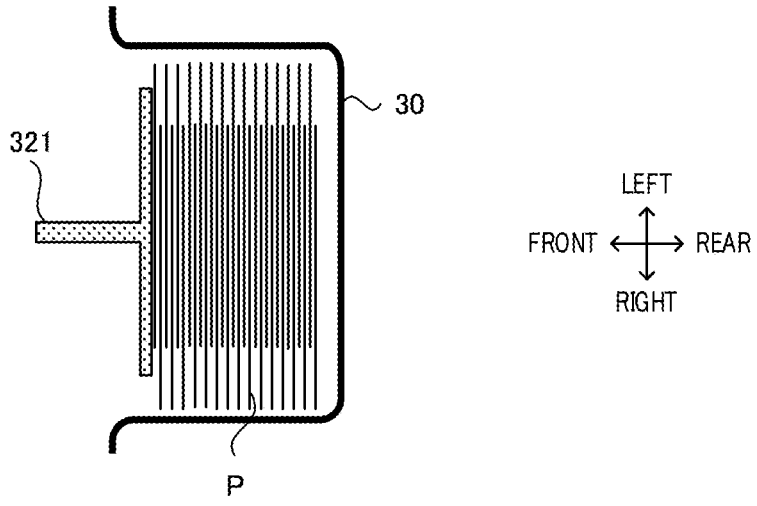
FIG. 10B is a schematic diagram illustrating a state in a case where banknotes have been transported to the collection unit by the width alignment transport processing in Embodiment 3.
Figure 11:
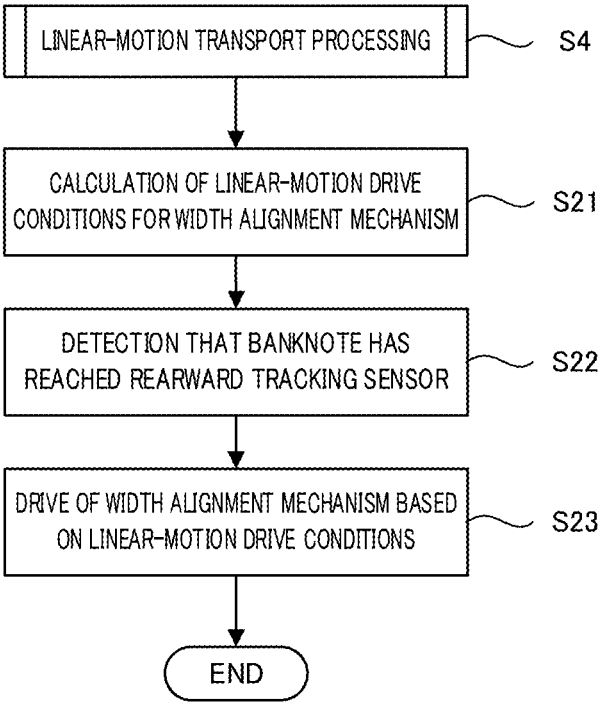
FIG. 11 is a flowchart for the linear-motion transport processing in Embodiment 3.
Figure 12:
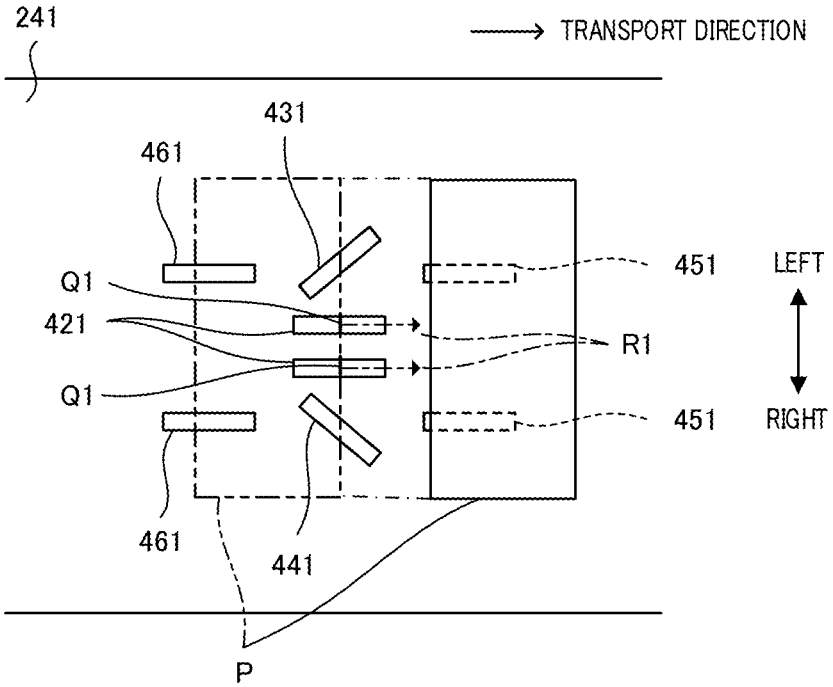
FIG. 12 is a diagram provided for describing an operation of the banknote processing apparatus in a case where a banknote is transported in a linear-motion manner in Embodiment 3.

Next, the depositing processing will be described as an operation of the banknote processing apparatus 2. The depositing processing refers to processing of storing, among the banknotes P inputted into the banknote processing apparatus 2, a banknote P to be collected in the collection unit 3 and storing, among the banknotes P inputted into the banknote processing apparatus 2, a banknote P to be recycled in the storage apparatuses 221 to 225 for each denomination. Note that, hereinafter, processing of transporting the banknotes P on the first transport path 241 while selectively aligning a plurality of the banknotes P in the left direction or the right direction for each predetermined number of one or the plurality of banknotes P may also be referred to as "width alignment transport processing". Further, processing of transporting a plurality of the banknotes P on the first transport path 241 without aligning the banknotes Pin the left direction or the right direction may also be referred to as "linear-motion transport processing". FIG. 6 is a flowchart for the depositing processing. FIG. 7 is a flowchart for the width alignment transport processing. FIG. 8A is a diagram provided for describing an operation of the banknote processing apparatus in a case where a banknote is aligned in the left direction. FIG. 8B is a diagram provided for describing an operation of the banknote processing apparatus in a case where a banknote is aligned in the right direction. FIGS. 9A, 9B, 9C, and 9D are diagrams provided for describing operations of the collection unit. FIG. 10A is a schematic diagram illustrating a state in a case where banknotes have been transported to the collection unit by the linear-motion transport processing. FIG. 10B is a schematic diagram illustrating a state in a case where banknotes have been transported to the collection unit by the width alignment transport processing. FIG. 11 is a flowchart for the linear-motion transport processing. FIG. 12 is a diagram provided for describing an operation of the banknote processing apparatus in a case where a banknote is transported in a linear-motion manner.

For example, when the user inputs a plurality of the banknotes P to be deposited into the depositing unit 211, the banknotes P are transported one by one to the first transport path 241 through the second transport path 242 of the transport unit 24. The recognition unit 215 recognizes the denomination and fitness of the banknote P transported through the first transport path 241 and transmits a recognition result to the control unit 234. The recognition unit 215 detects the inclination of the banknote P with respect to the front-rear direction, the size of the banknote P, and the position of the banknote Pin the width direction of the transport path, and transmits a detection result to the control unit 234. As indicated in FIG. 6, the control unit 234 acquires the recognition result described above and the detection result described above from the recognition unit 215 (step S1)

Next, the control unit 234 determines, based on the recognition result of the recognition unit 215, whether the width alignment transport processing on the banknote P is performed (step S2). In a case where the banknote P is a banknote P to be collected, that is, in a case where the banknote P is not a banknote P to be recycled, the control unit 234 determines that the width alignment transport processing on the banknote P is performed (step S2: YES). Thereafter, the control unit 234 causes the width alignment transport processing on the banknote P to be performed (step S3). The banknote P to be transported in a width-alignment manner is transported to the collection unit 3 as described later.

On the other hand, for example, in a case where the banknote P is not a banknote P to be collected, that is, in a case where the banknote P is a banknote P to be recycled, the control unit 234 determines that the width alignment transport processing on the banknote P is not performed (step S2: NO). Thereafter, the control unit 234 causes the linear-motion transport processing on the banknote P to be performed (step S4). The banknote P to be transported in a linear-motion manner is transported to one of the five storage apparatuses 221 to 225 for each denomination.

After the processing in step S3 or step S4, the control unit 234 determines whether the depositing processing is ended (step S5). For example, in a case where the recognition unit 215 has performed the recognition processing within a predetermined time, the control unit 234 determines that the depositing processing is not ended. Further, in a case where the recognition unit 215 has not performed the recognition processing within the predetermined time, the control unit 234 determines that the depositing processing is ended. In a case where the control unit 234 determines that the depositing processing is ended (step S5: YES), the control unit 234 causes the depositing processing to be ended. In a case where the control unit 234 determines that the depositing processing is not ended (step S5: NO), the control unit 234 acquires a recognition result and a detection result for the next banknote P from the recognition unit 215 (step S1).

Next, the width alignment transport processing on the banknote P in step S3 will be described. As indicated in FIG. 7, the control unit 234 sets an aligning direction of a plurality of the banknotes P (step S11). The control unit 234 sets the aligning direction to the left direction or the right direction for each predetermined number of one or the plurality of banknotes P. Note that, the predetermined number may be a fixed value set by the manufacturer of the banknote processing apparatus 2 or may be a value set by the user in accordance with use conditions.

The control unit 234 calculates an aligning amount of the banknote P (step S12). The control unit 234 calculates the aligning amount based on the detection result of the inclination of the banknote P with respect to the front-rear direction and the position of the banknote P in the width direction of the transport path such that a distance between an end part of the banknote P subjected to the width alignment processing and an end part of the first transport path 241 is approximately the same length. For example, in a case where the banknote P is aligned in the left direction, the control unit 234 calculates the aligning amount such that a distance GL between an end part of the banknote P subjected to the width alignment processing and an end part of the first transport path 241 is approximately the same length as illustrated in FIG. 8A. Further, in a case where the banknote P is aligned in the right direction, the control unit 234 calculates the aligning amount such that a distance GR between an end part of the banknote P subjected to the width alignment processing and an end part of the first transport path 241 is approximately the same length as illustrated in FIG. 8B.

FIG. 7 will be described again. After calculating the aligning amount, the control unit 234 sets width alignment drive conditions 1, 2, and 3 for the width alignment mechanism 4 described below based on the detection result of the inclination of the banknote P with respect to the front-rear direction, the size of the banknote P, and the position of the banknote P in the width direction of the transport path (step S13). Note that, since setting processing of the width alignment drive conditions 1 to 3 when the banknote P is aligned in the left direction and setting processing of the width alignment drive conditions 1 to 3 when the banknote P is aligned in the right direction are substantially the same, the setting processing when the banknote P is aligned in the left direction will be described in detail:

Width Alignment Drive Condition 1: the magnitudes of the grip pressures with respect to the banknote P in the transport units 42, 43, 44, 45, and 46;

Width Alignment Drive Condition 2: the velocities of rotation of the drive rollers 421, 431, 441, 451, and 461; and Width Alignment Drive Condition 3: the on/off states of the transport units 42, 43, 44, 45, and 46.

Note that, the grip pressures in the transport units 42, 43, 44, 45, and 46 refers to the pressing forces of the driven rollers 422, 432, and 442,452,462 on the drive rollers 421, 431, 441, 451, and 461, respectively.

In a case where the width alignment drive condition 1 when the banknote P is aligned in the left direction is set, the control unit 234 sets the grip pressures of the transport units 42, 43, and 44 so as to satisfy the following relationships:

the grip pressure of the left-skew transport unit 43>the grip pressure of the linear-motion transport units 42>0; and the grip pressure of the right-skew transport unit 44=0.

Further, the control unit 234 sets the grip pressures of the transport units 45 and 46 (the frontward linear-motion transport units 45 and the rearward linear-motion transport units 46) to values greater than 0. The grip pressures of the transport units 45 and 46 may be values equal to or greater than the grip pressure of the linear-motion transport units 42 or may be values less than the grip pressure of the linear-motion transport units 42. The grip pressure of the frontward linear-motion transport units 45 may be the same as or different from the grip pressure of the rearward linear-motion transport units 46.

In a case where the width alignment drive condition 2 when the banknote P is aligned in the left direction is set, the control unit 234 sets the velocity of rotation of the linear-motion drive rollers 421 to R1 and sets the velocity of rotation of the left-skew drive roller 431 to R2 as illustrated in FIG. 8A. The velocity of rotation R2 of the left-skew drive roller 431 is set such that the velocity of a component of velocity R21 (velocity component R21) in the transport direction D1 is the same as the velocity of the velocity of rotation R1 along the transport direction D1 of the linear-motion drive rollers 421. Note that, hereinafter, the component of velocity in the transport direction may also be referred to as "transport-direction component of velocity". Further, the control unit 234 sets the velocity of rotation of the right-skew drive roller 441 to 0 and sets the velocities of rotation of the drive rollers 451 and 461 (the frontward drive rollers 451 and the rearward drive rollers 461) to values greater than 0. The velocities of rotation of the drive rollers 451 and 461 may be values equal to or greater than the velocity of rotation of the linear-motion drive rollers 421 or may be values less than the velocity of rotation of the linear-motion drive rollers 421. The velocity of rotation of the frontward drive rollers 451 may be the same as or different from the velocity of rotation of the rearward drive rollers 461.

In a case where the width alignment drive condition 3 when the banknote P is aligned in the left direction is set, the control unit 234 sets the on/off states such that the rearward linear-motion transport units 46 are turned on and the transport units 42, 43, 44, and 45 are turned off until a front end part of the banknote P or predetermined positions in the plane thereof reach the contact positions Q1 and Q2, for example. Further, when the front end part of the banknote P or the predetermined positions in the plane thereof have reached the contact positions Q1 and Q2, the control unit 234 sets the on/off states based on the velocity of rotation of the rearward drive rollers 461 such that the transport units 42 and 43 are turned on and the transport units 44, 45, and 46 are turned off. Further, the control unit 234 sets, based on the velocities of rotation of the drive rollers 421 and 431, the length of a duration during which the transport units 42 and 43 are turned on. The longer the duration during which the transport units 42 and 43 are turned on, the greater the aligning amount of the banknote P in the left direction. Further, the control unit 234 sets the on/off states such that the transport units 42, 43, 44, and 46 are turned off and the frontward linear-motion transport units 45 are turned on when the front end part of the banknote P or the predetermined positions in the plane thereof have come into contact with the frontward drive rollers 451.

In a case where the width alignment drive condition 1 when the banknote P is aligned in the right direction is set, on the other hand, the control unit 234 sets the grip pressures of the transport units 42, 43, and 44 so as to satisfy the following relationships:

the grip pressure of the right-skew transport unit 44>the grip pressure of the linear-motion transport units 42>0; and the grip pressure of the left-skew transport unit 43=0.

Further, in a case where the width alignment drive condition 2 when the banknote P is aligned in the right direction is set, the control unit 234 sets the velocity of rotation of the linear-motion drive rollers 421 to R1 and sets the velocity of rotation of the right-skew drive roller 441 to R3 as illustrated in FIG. 8B. The velocity of rotation R3 of the right-skew drive roller 441 is set such that the velocity of a transport-direction component of velocity R31 is the same as the velocity of the velocity of rotation R1 along the transport direction D1 of the linear-motion drive roller 421.

The control unit 234 sets the grip pressures of the transport units 45 and 46 in the width alignment drive condition 1, the velocities of rotation of the drive rollers 451 and 461 in the width alignment drive condition 2, and the width alignment drive condition 3 in the same manner as when the banknote P is aligned in the left direction.

FIG. 7 will be described again. After setting the width alignment drive conditions 1, 2, and 3 for the width alignment mechanism 4, when it is detected that the banknote P has reached the rearward tracking sensor 48 (step S14), the control unit 234 causes the banknote P to be aligned in the direction set in step S11 by causing the width alignment mechanism 4 to be driven based on the width alignment drive conditions 1, 2, and 3 (step S15).

For example, in a case where the banknote P is aligned in the left direction, when the banknote P has reached the rearward tracking sensor 48, the control unit 234 causes the banknote P to be transported in the transport direction D1 by turning on the rearward linear-motion transport units 46 and turning off the transport units 42, 43, 44, and 45 at a predetermined timing. Thereafter, when the front end part of the banknote P or the predetermined positions in the plane thereof have reached the contact positions Q1 and Q2, the control unit 234 turns on the transport units 42 and 43 and turns off the transport units 44, 45, and 46. As illustrated in FIG. 8A, the banknote P is aligned in the left direction by a difference between frictional forces corresponding to a difference between the grip pressures of the linear-motion transport units 42 and the left-skew transport unit 43.

Here, when the transport units 42 and 43 are turned on while the rearward linear-motion transport units 46 are on, the banknote P may be wrinkled in a case where the velocity of rotation of the linear-motion drive rollers 421 is slower than the velocity of rotation of the rearward drive rollers 461, for example. Further, in a case where the velocity of rotation of the linear-motion drive rollers 421 is faster than the velocity of rotation of the rearward drive rollers 461, the banknote P may be stretched and damaged. On the other hand, turning on the transport units 42 and 43 and turning off the rearward linear-motion transport units 46 as in Embodiment 3 make it possible to suppress occurrence of the defects described above.

Further, in a case where the transport-direction component of velocity R21 of the left-skew drive roller 431 differs from the velocity of the velocity of rotation R1 of the linear-motion drive rollers 421, the banknote P may be aligned in the left direction while rotating. On the other hand, causing the velocity of the transport-direction component of velocity R21 of the left-skew drive roller 431 to be the same as the velocity of the velocity of rotation R1 of the linear-motion drive rollers 421 as in Embodiment 3 makes it possible to align the banknote P in the left direction while suppressing the rotation as illustrated in FIG. 8A.

Further, for example, in a case where the contact position Q1 is located forward or rearward from the contact position Q2, the timings of giving drive forces to the banknote P by the transport units 42 and 43 differ so that the banknote P may be aligned in the left direction while rotating. On the other hand, locating the contact positions Q1 and Q2 on the reference line Q0 orthogonal to the transport direction D1 as in Embodiment 3 makes it possible to cause the timings of giving drive forces to the banknote P by the transport units 42 and 43 to be substantially the same and makes it possible, as illustrated in FIG. 8A, to align the banknote P in the left direction while suppressing the rotation.

Thereafter, when the duration during which the transport units 42 and 43 are on becomes the duration set in the width alignment drive condition 3, the transport units 42, 43, 44, and 46 are turned off and the frontward linear-motion transport units 45 are turned on.

Here, when the frontward linear-motion transport units 45 are turned on while the transport units 42 and 43 are on, the banknote P may be wrinkled in a case where the velocity of rotation of the linear-motion drive rollers 421 is faster than the velocity of rotation of the frontward drive rollers 451, for example. Further, in a case where the velocity of rotation of the linear-motion drive rollers 421 is slower than the velocity of rotation of the frontward drive rollers 451, the banknote P may be stretched and damaged. On the other hand, turning off the transport units 42 and 43 and turning on the frontward linear-motion transport units 45 as in Embodiment 3 make it possible to suppress occurrence of the defects described above.

Further, in a case where the banknote P is aligned in the right direction, the control unit 234 performs the same processing as when the banknote P is aligned in the left direction so that the banknote P can be aligned in the right direction while suppressing the rotation as illustrated in FIG. 8B.

A plurality of the banknotes P to be collected, which has been aligned in the left direction or the right direction for each predetermined number of one or the plurality of banknotes P by the width alignment transport processing in step S3, is transported to the collection unit 3. As illustrated in FIG. 9A, the control unit 234 causes the feeding unit 323 to feed out the predetermined number of the one or plurality of banknotes P into a temporary storage unit SP which is the inner space of the movement unit 32, and causes the predetermined number of the one or plurality of banknotes P to be stored such that the predetermined number of the one or plurality of banknotes P lean against the regulation unit 322. When the predetermined number of the one or plurality of banknotes P is stored in the temporary storage unit SP, the control unit 234 causes the regulation unit 322 to open as indicated in FIG. 9B. Then, the control unit 234 causes the compression unit 321 to pushes the banknotes P onto a side of the storage bag 30 and causes the banknotes P to be stored and compressed inside the storage bag 30. Next, the control unit 234 causes the regulation unit 322 to be closed as indicated in FIG. 9C. Then, the control unit 234 causes the compression unit 321 to return to the original position as indicated in FIG. 9D.

Here, in a case where a plurality of the banknotes P is transported to the collection unit 3 by the linear-motion transport processing without being aligned in the left direction or the right direction for each predetermined number of one or the plurality of banknotes P, the gap between the bundle of the banknotes P and the inner peripheral surface of the storage bag 30 is large as illustrated in FIG. 10A so that when the compression unit 321 compresses the banknotes P, some of the banknotes P may buckle and exit from the entrance of the storage bag 30 depending on the position of the banknotes P in the left-right direction. On the other hand, transporting the banknotes P to the collection unit 3 by the width alignment transport processing as in Embodiment 3 reduces the gap between the bundle of the banknotes P and the inner peripheral surface of the storage bag 30 as indicated in FIG. 10B so that it is possible to suppress buckling of the banknotes P when the compression unit 321 compresses the banknotes P.

Next, the linear-motion transport processing on the banknote P in step S4 will be described. As illustrated in FIG. 11, the control unit 234 sets, based on the detection result of the inclination of the banknote P with respect to the transport direction, the size of the banknote P, and the position of the banknote P in the width direction of the transport path, linear-motion drive conditions 1, 2, and 3 for the width alignment mechanism 4 described below (step S21):

Linear-Motion Drive Condition 1: the magnitudes of the grip pressures of the transport units 42, 43, 44, 45, and 46;

Linear-Motion Drive Condition 2: the velocities of rotation of the drive rollers 421, 431, 441, 451, and 461; and Linear-Motion Drive Condition 3: the on/off states of the transport units 42, 43, 44, 45, and 46.

When the linear-motion drive condition 1 is set, the control unit 234 sets the grip pressures of the linear-motion transport units 42, the frontward linear-motion transport units 45, and the rearward linear-motion transport units 46 to predetermined value greater than 0 and sets the grip pressures of the left-skew transport unit 43 and the right-skew transport unit 44 to 0. The grip pressures of the linear-motion transport units 42, the frontward linear-motion transport units 45, and the rearward linear-motion transport units 46 may be the same as or different from the grip pressures in the width alignment drive condition 1.

When the linear-motion drive condition 2 is set, the control unit 234 sets the velocities of rotation of the linear-motion drive rollers 421, the frontward drive rollers 451, and the rearward drive rollers 461 to R1 and sets the velocities of rotation of the left-skew drive roller 431 and the right-skew drive roller 441 to 0 as illustrated in FIG. 12. Note that, the velocities of rotation of the frontward drive rollers 451 and the rearward drive rollers 461 may be different from the velocity of rotation of the linear-motion drive rollers 421.

When the linear-motion drive condition 3 is set, the control unit 234 sets the on/off states such that the rearward linear-motion transport units 46 are turned on and the transport units 42, 43, 44, and 45 are turned off until the front end part of the banknote P or a predetermined position in the plane thereof reaches the contact position Q1, for example. Further, when the front end part of the banknote P or the predetermined position in the plane thereof has reached the contact position Q1, the control unit 234 sets the on/off states based on the velocity of rotation of the rearward drive rollers 461 such that the linear-motion transport units 42 are turned on and the transport units 43, 44, 45, and 46 are turned off. Further, the control unit 234 sets the on/off states based on the velocity of rotation of the drive rollers 421 such that the transport units 42, 43, 44, and 46 are turned off and the frontward linear-motion transport units 45 are turned on when the front end part of the banknote P or the predetermined position in the plane thereof has come into contact with the frontward drive roller 451.

FIG. 11 will be described again. After setting the linear-motion drive conditions 1 and 2 for the width alignment mechanism 4, when it is detected that the banknote P has reached the rearward tracking sensor 48 (step S22), the control unit 234 causes the banknote P to be transported in a linear-motion manner by causing the width alignment mechanism 4 to be driven based on the linear-motion drive conditions 1, 2, and 3 (step S23).

When the banknote P has reached the rearward tracking sensor 48, the control unit 234 causes the banknote P to be transported in the transport direction D1 by turning on the rearward linear-motion transport units 46 and turning off the transport units 42, 43, 44, and 45 at a predetermined timing. Thereafter, when the front end part of the banknote P or the predetermined positions in the plane thereof have reached the contact position Q1, the control unit 234 turns on the linear-motion transport units 42 and turns off the transport units 43, 44, 45, and 46.

Here, when the linear-motion transport units 42 are turned on while the rearward linear-motion transport units 46 are on, the banknote P may be wrinkled or may be stretched and damaged in the same manner as in the width alignment transport processing. On the other hand, turning on the linear-motion transport units 42 and turning off the rearward linear-motion transport units 46 as in Embodiment 3 make it possible to suppress occurrence of the defects described above.

Thereafter, when the front end part of the banknote P or the predetermined position in the plane thereof has come into contact with the frontward drive roller 451, the transport units 42, 43, 44, and 46 are turned off and the frontward linear-motion transport units 45 are turned on.

Here, when the frontward linear-motion transport units 45 are turned on while the linear-motion transport units 42 are on, the banknote P may be wrinkled or may be stretched and damaged in the same manner as in the width alignment transport processing. On the other hand, turning off the linear-motion transport units 42 and turning on the frontward linear-motion transport units 45 as in Embodiment 3 make it possible to suppress occurrence of the defects described above.

With the above processing, the banknote P is transported along the transport direction D1 without being aligned in the left direction or the right direction and without rotating as illustrated in FIG. 12. Then, the banknote P to be recycled, which is transported by the linear-motion transport processing in step S4, is transported to one storage apparatus of the five storage apparatuses 221 to 225 for each denomination. Thus, storing the banknote P to be recycled in the storage apparatuses 221 to 225 by the linear-motion transport processing makes it possible to configure that the position of the banknote P in the left-right direction in the dispensing unit 212 when the banknote P is dispensed is substantially the same position.

Variations of Embodiment

It goes without saying that the present disclosure is not limited to those indicated in the embodiments described thus far, and various modifications can be made without departing from the spirit of the present disclosure. The embodiments described above and variations that are indicated below may be combined in any way as long as it is applicable.

For example, although each of the transport units 42, 43, and 44 is formed of a pair of rollers in Embodiment 3, a transport belt may be applied instead of at least one of the pair of rollers. Further, the driven rollers 422, 432, and 442 may be configured to be driven in the same manner as the drive rollers 421, 431, and 441. Further, the drive rollers 421, 431, and 441 may be disposed on the upper side of the transport path and the driven rollers 422, 432, and 442 may be disposed on the lower side of the transport path. Further, for example, the drive rollers 421, 431, and 441 may be disposed instead of the driven rollers 422, 432, and 442 on the upper side (one main surface side) of the banknote P, the drive rollers 421, 431, and 441 may not be disposed on the lower side of the banknote P, and positions on the upper surface of the first transport path 241, which face the drive rollers 421, 431, and 441, respectively, may be formed in a plane shape. In this case, the width alignment transport processing or the linear-motion transport processing can be performed by lowering the drive rollers 421, 431, and 441 to press the banknote P against the upper surface of the first transport path 241 when the transport units 42, 43, and 44 are turned on, and by raising the drive rollers 421, 431, and 441 to separate the drive rollers 421, 431, and 441 from the banknote P when the transport units 42, 43, and 44 are turned off.

In Embodiment 3, the transport-direction component of velocity R21 of the left-skew drive roller 431 or the transport-direction component of velocity R31 of the right-skew drive roller 441 may be configured to be slower or faster than the velocity of rotation R1 of the linear-motion drive roller 421.

For example, in a case where the banknote P is aligned in the left direction in Embodiment 3, the transport units 42 and 43 may be turned on while the rearward linear-motion transport units 46 are on, or the frontward linear-motion transport units 45 may be turned on while the transport units 42 and 43 are on.

Although all of the contact positions Q1, Q2, and Q3 are disposed on the reference line Q0 orthogonal to the transport direction D1 in Embodiment 3, the contact position Q1 may be disposed forward or rearward from the contact positions Q2 and Q3, for example.

In Embodiment 3, processing of aligning a plurality of the banknotes P in the left direction or the right direction for each predetermined number of one or the plurality of banknotes P and processing of aligning the banknotes P neither to the left nor to the right may be performed instead of the width alignment transport processing. Further, processing of aligning a plurality of the banknotes Pin the left direction for each predetermined number of one or the plurality of banknotes P, processing of aligning a plurality of the banknotes P in the right direction for each predetermined number of one or the plurality of banknotes P, and processing of aligning a plurality of the banknotes P neither to the left nor to the right may be performed instead of the width alignment transport processing.

In Embodiment 3, it may be configured such that the user can select the width alignment transport processing or the linear-motion transport processing.

Although a configuration in which the width alignment mechanism 4 is disposed on the first transport path 241 has been exemplified in Embodiment 3, the width alignment mechanism 4 may be disposed inside the movement unit 32 of the collection unit 3.

Although a configuration in which the collection unit 3 comprises the attachment unit 31 to which the storage bag 30 is attached, that is, a type in which the banknote P is collected in the storage bag 30, has been exemplified in Embodiment 3, the collection unit 3 may be configured such that a collection cassette 600 is attached as illustrated in FIGS. 13 to 15C, for example. In this case, a movement unit for feeding a banknote into the collection cassette 600 as such can be the same as the movement unit 32 comprised in the collection unit 3 of a pouch (storage bag) type.

Figure 13:
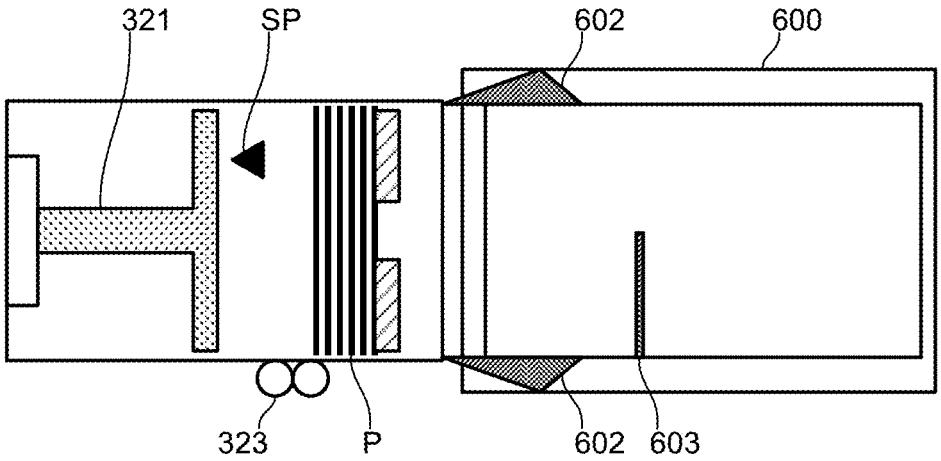
FIG. 13 is a schematic diagram illustrating another configuration of the collection unit in Embodiment 3.
Figure 14A:
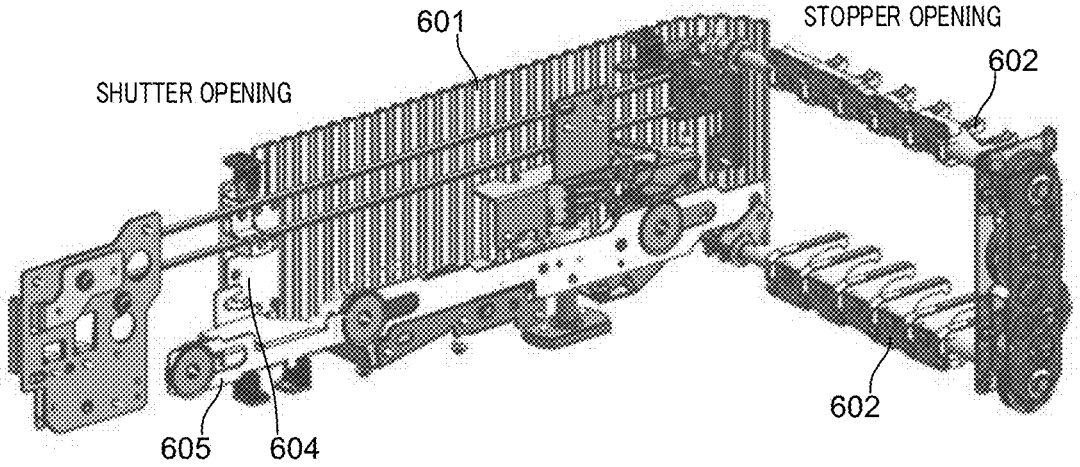
FIG. 14A is a perspective view of an exemplary main part of the collection unit of a type indicated in FIG. 13.
Figure 14B:
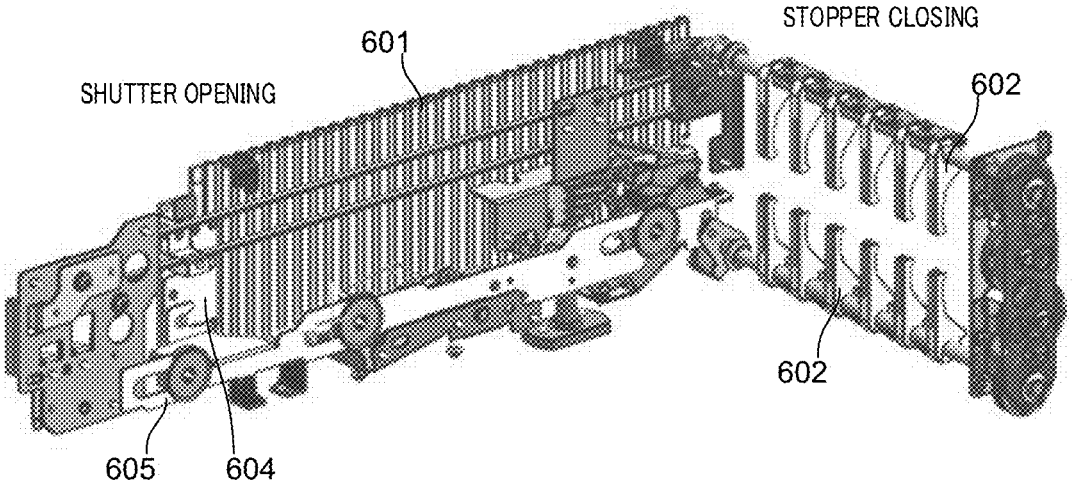
FIG. 14B is a perspective view of an exemplary main part of the collection unit of the type indicated in FIG. 13.

The collection cassette 600 usually comprises a shutter 601, a stopper 602, and a stage 603 as those to be driven for performing the function of the collection cassette 600 (see particularly FIGS. 13 and 14A). In the related art, each movable part that independently moves these shutter and stopper or the like comprises a dedicated actuator, but may be configured to comprise, for example, a mechanism for opening and closing the stopper 602 by means of the drive of the shutter 601 by utilizing a member that does not affect the opening and closing of the shutter 601. Specifically, for example, as illustrated in FIGS. 14A and 14B, the stopper 602 may be opened and closed by moving a link 605 on a side of the stopper 602 by a pin 604 on a side of the shutter 601 in a movable region after shutter opening (at this time, a spring tension is applied in a stopper-opening direction), that is, the stopper 602 may be opened and closed by moving the link 605 by hooking the pin 604 on the side of the shutter 601 to the link 605 on the side of the stopper 602. Thus, it is possible to configure the drive of the shutter 601 and the drive of the stopper 602 in the collection cassette 600 as one drive and to reduce the size and cost of the collection cassette 600. Note that, what is described above is applicable not only to a collection cassette, but also to a mechanism comprising: a partition which is required to be opened and closed in an apparatus, and a stopper which prevents a stored object from entering a movable range of the partition.

Further, for example, the collection cassette 600 may comprise an opening part configured to be opened and closed by the shutter 601 and the stopper 602 configured to hold a stored banknote, and a pusher 321 may push a bundle of banknotes as is, which has been stacked in advance in a temporary storage unit on a transport path, into the collection cassette 600 (see particularly FIG. 13). In this case, opening the stopper 602 outward enables the stopper 602 not only to hold the banknotes (at the time of closing), but also to serve as a guide for connection with a transport unit (at the time of opening) so that the size of the collection cassette 600 can be reduced, and further opening the stopper 602 outward makes extra pushing at the time of stopper closing unnecessary (that is, there is no need to put an extra mechanism between units) and makes it possible to utilize a storage space without waste so that the capacity of the collection cassette 600 can be increased. In addition, since the pusher 321 and the position of cassette closing can be configured to intersect, the capacity of the collection cassette 600 can also be increased in terms of being capable of closing the stopper 602 while maintaining a state in which banknotes are compressed by the pusher 321 and the stage 603. Further, stacking quality can be improved because it is possible to stack banknotes in advance in a temporary storage unit comprising a required minimum space, to cause the pusher 321 to push and stack a bundle of the banknote into and in the collection cassette 600, and finally to close the stopper 602 while the bundle of banknotes is pushed by the pusher 321. Further, since a load is applied to the stopper 602 and the stage 603 throughout transport of the collection cassette 600 in a state as is in which banknotes are compressed by the stopper 602 and the stage 603, the stage 603 may be lowered by a fixed amount in accordance with the number of banknotes and the position of the stage 603 after stopper closing is completed and the pressure may be reduced. In the collection cassette 600 comprising the stopper 602 and capable of compressing and storing banknotes as described above, pushing and storing can be performed not only in the horizontal direction, but also in any of oblique and up-down directions as long as stacking in the temporary storage unit can be performed. In addition, for example, although it is possible to realize a more increased capacity, a more improved stacking quality, and more stable stopper closing by further controlling the position of the stage comprising a holding force capable of resisting the pressing of the pusher by means of a stepper motor, even a stage that is simply pushed up by a spring all the time makes it possible to compress and store banknotes in the same manner.

Figure 15A:
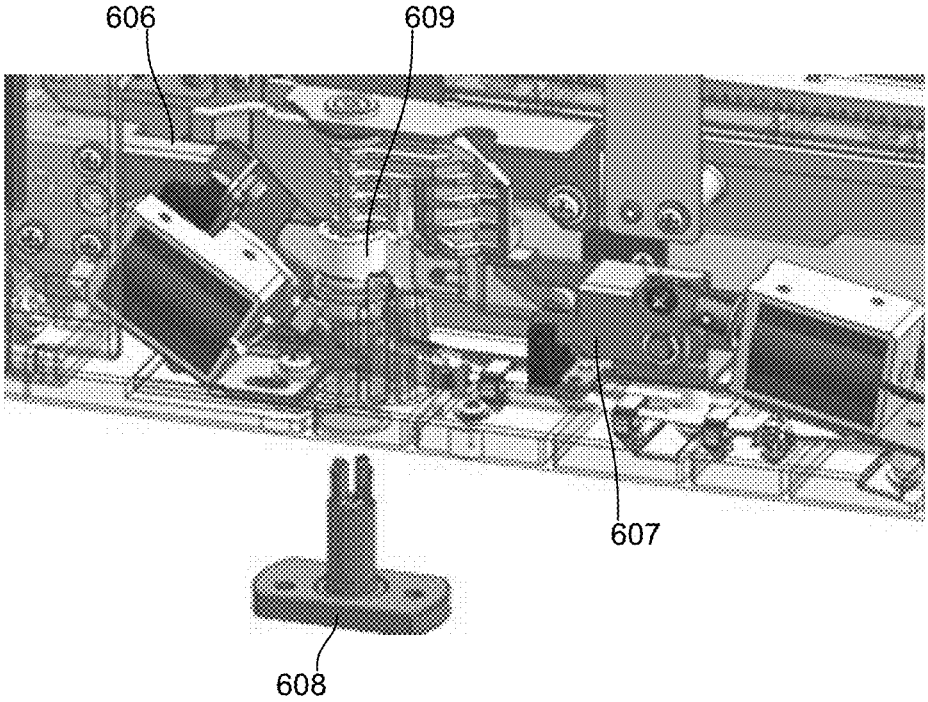
FIG. 15A is a diagram provided for describing an exemplary locking mechanism of the collection unit of the type indicated in FIG. 13.
Figure 15B:
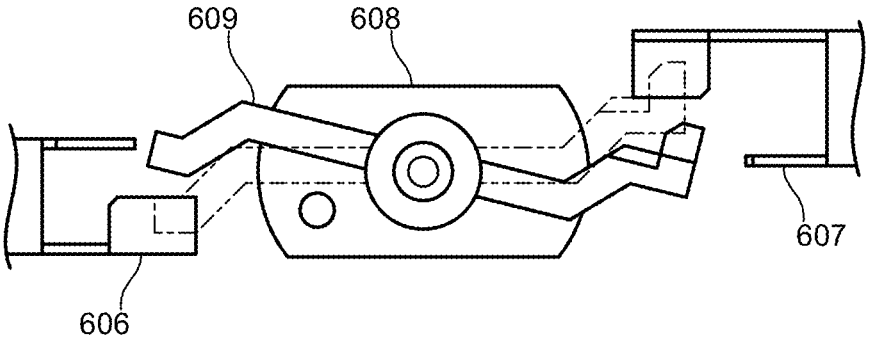
FIG. 15B is a diagram provided for describing an operation of the locking mechanism indicated in FIG. 15A.
Figure 15C:
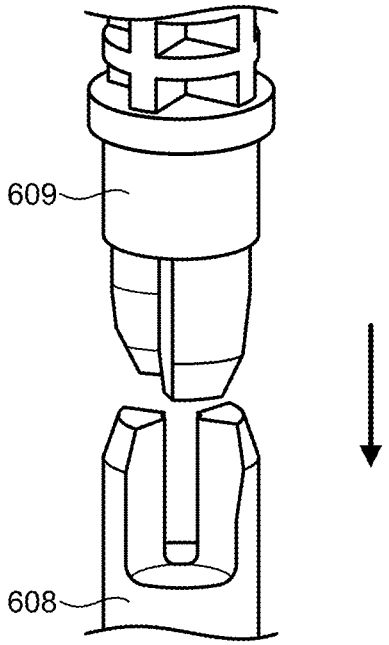
FIG. 15C is a diagram provided for describing an operation of the locking mechanism indicated in FIG. 15A.

Further, since it is necessary for security to unlock the collection cassette 600 after the collection cassette 600 is set and stored in a safe, the collection cassette 600 may comprise a two-step lock 609 corresponding to two electromagnetic lock levers on a side of the shutter and on a side of the stopper as illustrated in FIGS. 15A to 15C, for example. Since the collection cassette 600 is required not to be unlocked even in the event of a fall and a lock spring cannot be sufficiently strengthened in the case of electromagnetic lock, the lock of the collection cassette 600 is realized as the two-step lock 609 which is a mechanical two-step lock that is unlocked when the collection cassette 600 is set. Specifically, this two-step lock 609 as a mechanical two-step lock comprises a structure corresponding to a shutter-side lock lever 606 and a stopper-side lock lever 607 and is configured such that when the collection cassette 600 is lowered, a frame-side release pin 608 is inserted thereto, levers of the two-step lock 609 rotate, and the lock is unlocked (the electromagnetic lock can be unlocked in this state). In FIG. 15B, the state in which the levers of the two-step lock 609 are locking the shutter-side lock lever 606 and the stopper-side lock lever 607 is indicated with the broken line, and the state in which the collection cassette 600 is set, the frame-side release pin 608 is inserted thereto, and the lock is unlocked is indicated with the solid line. At this time, when the spring load direction of the two-step lock 609 is configured to be the horizontal direction, the spring load direction of the two-step lock 609 becomes a direction different from the spring load direction (the vertical direction) of the electromagnetic lock so that the two-step lock 609 becomes resistant to a strong impact in one direction. Further, since the spring load direction of the two-step lock 609 is not the gravitational direction (the vertical direction), even a strengthened spring load of the two-step lock 609 (that is, torsion coil springs of the levers of the two-stage lock), which is strengthened such that the two-step lock 609 is not detached by an impact, hardly becomes resistance when the collection cassette 600 is set, and floating after half setting or setting also hardly occurs. In the collection cassette 600 comprising the two-step lock 609 as a mechanical two-step lock with less repulsion load as described above, the two-step lock 609 corresponds to the two locks on the side of the shutter and on the side of the stopper side, but the number of corresponding locks is not limited to two. For example, the two-step lock 609 can correspond to three or more locks by disposing a lock part in a circular shape or by disposing the lock part radially displaced with respect to the same axis of rotation.

For example, a voucher, a check, or the like may also be applied as the sheet that is utilized for the aligner, the sheet processing apparatus, and the sheet width alignment method of the present disclosure.

Reference Embodiment

Next, a reference embodiment will be described with reference to the accompanying drawings.

<Configuration of Banknote Processing Apparatus>

Figure 16:
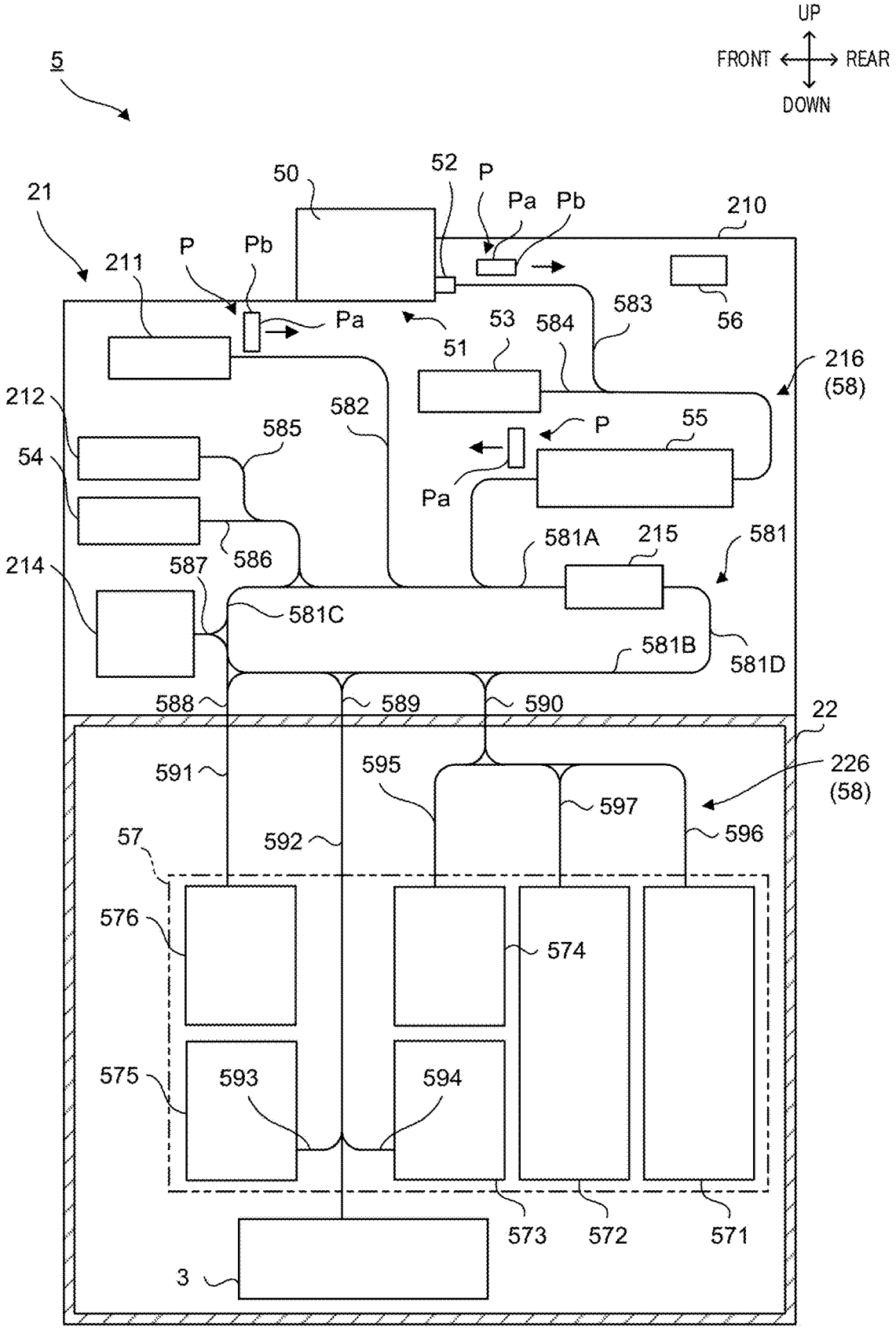
FIG. 16 is a schematic diagram illustrating a schematic configuration of the banknote processing apparatus in a reference embodiment.

First, a configuration of a banknote processing apparatus will be described. FIG. 16 is a schematic diagram illustrating a schematic configuration of the banknote processing apparatus. Note that, the same configurations as those of the banknote processing apparatus 2 in Embodiment 3 will be denoted by the same names and the same reference signs, and descriptions thereof will be omitted or simplified.

A banknote processing apparatus 5 illustrated in FIG. 16 is an example of the sheet processing apparatus of the present disclosure. The banknote processing apparatus 5 comprises the processing unit 21 in the upper part and the safe unit 22 in the lower part. The processing unit 21 comprises the upper housing 210, and comprises the depositing unit 211, the dispensing unit 212, the temporary storage unit 214, the recognition unit 215, the upper-side transport unit 216, a cassette attachment section 51, a depositing/dispensing unit 52, an upper reject storage unit 53, a count reject storage unit 54, an attitude changing unit 55, and a control unit 56 which are disposed inside the upper housing 210. The temporary storage unit 214 temporarily stores a reject banknote generated in collection processing or reconciliation processing to be described later.

The depositing unit 211 comprises a feeding mechanism for feeding in (receiving) a plurality of the banknotes P, which has been stacked, one by one in an attitude in which a long side Pa of the banknote P is the front side thereof in the feeding-in direction. Hereinafter, the transport of the banknote P in the attitude in which the long side Pa thereof is the front side thereof in the transport direction may also be referred to as "long edge feed".

The cassette attachment section 51 is configured such that a banknote transport cassette 50 can be attached thereto. When the banknote transport cassette 50 is attached to the cassette attachment section 51, the control unit 56 can control the banknote transport cassette 50.

The banknote transport cassette 50 comprises at least a feeding mechanism for discharging the banknote P in an attitude in which a short-side Pb of the banknote P is the front side thereof in the transport direction, a storage mechanism for storing the banknote P to be transported in an attitude in which the short-side Pb thereof is the front side thereof in the transport direction, and motors for driving these mechanisms. Hereinafter, the transport of the banknote Pin the attitude in which the short side Pb thereof is the front side thereof in the transport direction may also be referred to as "short edge feed".

The depositing/dispensing unit 52 comprises an opening (port) for receiving the banknote P that has been discharged and short edge fed from the banknote transport cassette 50 attached to the cassette attachment section 51 and for transporting the banknote P to the upper-side transport unit 216 without changing the attitude of the banknote P. The opening of the depositing/dispensing unit 52 is also an opening for transporting the banknote P, which has been short edge fed from the upper-side transport unit 216, to the banknote transport cassette 50 without changing the attitude of the banknote P.

The upper reject storage unit 53 is configured to store the banknote P determined as not dispensable by the control unit 56 based on a recognition result of the recognition unit 215 at the time of dispensing processing of dispensing the banknote P stored in a storage unit 57 to be described later to the banknote transport cassette 50, for example. The upper reject storage unit 53 is configured to be capable of taking out the banknote P, which has been stored, from outside.

For example, at the time of the depositing processing of the banknote P discharged from the banknote transport cassette 50 to the upper-side transport unit 216, the count reject storage unit 54 stores, among the banknotes P determined as not depositable, the banknote P determined as being in a particularly considerably skewed state by the control unit 56 based on the recognition result of the recognition unit 215. The count reject storage unit 54 is configured to be capable of taking out the banknote P, which has been stored, from outside.

The attitude changing unit 55 changes the attitude of the banknote P, which is being transported from the depositing/dispensing unit 52 toward the recognition unit 215, from a short-edge-feed attitude to a long-edge-feed attitude. The attitude changing unit 55 changes the attitude of the banknote P, which is being transported from the recognition unit 215 toward the depositing/dispensing unit 52, from the long-edge-feed attitude to the short-edge-feed attitude.

The control unit 56 integrally controls the banknote processing apparatus 5. Specific processing of the control unit 56 will be described later.

In the safe unit 22, the lower-side transport unit 226, the storage unit 57, and the collection unit 3 are disposed.

The storage unit 57 comprises a first storage cassette 571, a second storage cassette 572, a third storage cassette 573, a fourth storage cassette 574, a fifth storage cassette 575, and a sixth storage cassette 576. The first to sixth storage cassettes 571 to 576 feed in and store the banknotes P one by one and feed out the banknotes P, which have been stored, one by one. Denominations of the banknotes P to be stored in the first to fifth storage cassettes 571 to 575 are set in advance, respectively.

The upper-side transport unit 216 and the lower-side transport unit 226 form a transport unit 58. The transport unit 58 transports the banknotes P one by one with an appropriate distance between the banknotes P in the banknote processing apparatus 5.

The upper-side transport unit 216 comprises a first transport path 581, a second transport path 582, a third transport path 583, a fourth transport path 584, a fifth transport path 585, a sixth transport path 586, a seventh transport path 587, an eighth transport path 588, a ninth transport path 589, and a tenth transport path 590.

The first transport path 581 is formed in a loop shape. The first transport path 581 comprises an upper-side path 581A extending frontward and rearward, a lower-side path 581B extending frontward and rearward below the upper-side path 581A, a front reverse rotation path 581C connecting the upper-side path 581A and the lower-side path 581B on the front side, and a rear reverse rotation path 581D connecting the upper-side path 581A and the lower-side path 581B on the rear side. The upper-side path 581A is provided with the recognition unit 215.

The second transport path 582 connects a position on the upper-side path 581A frontward from the recognition unit 215 and the depositing unit 211. The third transport path 583 connects a position on the upper-side path 581A rearward from the connection position with the second transport path 582 and frontward from the recognition unit 215 and the depositing/dispensing unit 52. The third transport path 583 is provided with the attitude changing unit 55. The fourth transport path 584 connects the upper reject storage unit 53 and the third transport path 583. The fifth transport path 585 connects a position on the upper-side path 581A frontward from the connection position with the second transport path 582 and the dispensing unit 212. The sixth transport path 586 connects the fifth transport path 585 and the count reject storage unit 54. The seventh transport path 587 connects the front reverse rotation path 581C and the temporary storage unit 214. Each of the eighth transport path 588, the ninth transport path 589, and the tenth transport path 590 connects the lower-side path 581B and the lower-side transport unit 226.

The lower-side transport unit 226 comprises an eleventh transport path 591, a twelfth transport path 592, a thirteenth transport path 593, a fourteenth transport path 594, a fifteenth transport path 595, a sixteenth transport path 596, and a seventeenth transport path 597. The eleventh transport path 591 connects the eighth transport path 588 and the sixth storage cassette 576. The twelfth transport path 592 connects the ninth transport path 589 and the collection unit 3. The thirteenth transport path 593 connects the twelfth transport path 592 and the fifth storage cassette 575. The fourteenth transport path 594 connects the twelfth transport path 592 and the third storage cassette 573. The fifteenth transport path 595 connects the tenth transport path 590 and the fourth storage cassette 574. The sixteenth transport path 596 connects the fifteenth transport path 595 and the first storage cassette 571. The seventeenth transport path 597 connects the sixteenth transport path 596 and the second storage cassette 572.

In each part of the transport unit 58, tracking sensors (illustrations thereof will be omitted) that detect the passage of a banknote are disposed. Upon receiving a command from the control unit 56, the transport unit 58 transports the banknote P to a predetermined transport destination based on detection signals of the tracking sensors.

<Operation of Banknote Processing Apparatus>

Next, an operation of the banknote processing apparatus 5 will be described.

<Depositing Processing>

First, the depositing processing into the storage unit 57 will be described. In the depositing processing, the banknote P from the depositing unit 211 or the banknote transport cassette 50 is deposited. In a case where the banknotes P are deposited from the depositing unit 211, the banknote P that can be deposited (normal banknote P) is deposited into the storage unit 57 and the banknote P that cannot be deposited (reject banknote P) is transported to the dispensing unit 212. In a case where the banknotes P are deposited from the banknote transport cassette 50, on the other hand, the normal banknote P is deposited into the storage unit 57 and the reject banknote P is transported to the count reject storage unit 54. Hereinafter, details of the depositing processing will be described.

<Depositing Processing from Depositing Unit>

In a case where a predetermined amount of the banknotes P is inputted into the depositing unit 211, the control unit 56 controls the transport unit 58 such that the banknotes P that have been inputted are transported to the first transport path 581. The control unit 56 then transports the banknotes P in the clockwise direction along the first transport path 581. The banknotes P to be transported along the first transport path 581 are recognized by the recognition unit 215. The control unit 56 controls the transport unit 58 based on the recognition result of the recognition unit 215 such that the normal banknote P is transported to the storage unit 57 and the reject banknote P is transported to the dispensing unit 212.

<Depositing Processing from Banknote Transport Cassette>

In a case where the banknotes P in the banknote transport cassette 50 are deposited based on an operation of an operation unit (not illustrated), the control unit 56 causes the banknotes P, which have been inputted, to be transported in the clockwise direction along the first transport path 581 and causes the recognition unit 215 to recognize the banknotes P. The control unit 56 then causes a normal banknote P to be transported to the storage unit 57 and causes a reject banknote P to be transported to the count reject storage unit 54.

<Dispensing Processing>

Next, the dispensing processing from the storage unit 57 will be described. In the dispensing processing, the banknotes P are dispensed to the dispensing unit 212 or the banknote transport cassette 50. In a case where the banknotes P are dispensed to the dispensing unit 212, the banknote P that can be dispensed (normal banknote P) is dispensed to the dispensing unit 212 and the banknote P that cannot be dispensed (reject banknote P) is transported to the collection unit 3 or the count reject storage unit 54. In a case where the banknotes P are dispensed to the banknote transport cassette 50, on the other hand, the normal banknote P is dispensed to the banknote transport cassette 50 and the reject banknote P is transported to the upper reject storage unit 53. Hereinafter, details of the dispensing processing will be described.

<Dispensing Processing to Dispensing Unit>

In a case where a predetermined amount of the banknotes P is dispensed to the dispensing unit 212 based on an operation of the operation unit, the control unit 56 causes the banknote P in the storage unit 57 to be transported in the counterclockwise direction along the first transport path 581 and causes the recognition unit 215 to recognize the banknote P. The control unit 56 then causes a normal banknote P to be transported to the dispensing unit 212 and causes a reject banknote P to be transported to the temporary storage unit 214.

When all the banknotes P to be dispensed are transported to the dispensing unit 212 or the temporary storage unit 214, the control unit 56 causes a reject banknote P in the temporary storage unit 214 to be transported in the clockwise direction along the first transport path 581 and causes the recognition unit 215 to recognize the reject banknote P. The control unit 56 then causes a reject banknote P recognized as a normal banknote P to be transported to the storage unit 57 and causes a reject banknote P recognized as a reject banknote P again to be transported to the collection unit 3 or the count reject storage unit 54.

Whether the transport destination of the reject banknote P at the time of the dispensing to the dispensing unit 212 is the collection unit 3 or the count reject storage unit 54 is set by, for example, the user. When the transport destination of the reject banknote P is set to the count reject storage unit 54, the reject banknote P at the time of the dispensing to the dispensing unit 212 and the reject banknote P at the time of depositing from the banknote transport cassette 50 may be mixedly present in the count reject storage unit 54. Thus, when reject banknotes P with different transaction contents are mixedly present in the count reject storage unit 54, it is not possible to accept the inventory amounts of the first to fifth storage cassettes 571 to 575. On the other hand, when the transport destination of the reject banknote P at the time of the dispensing to the dispensing unit 212 is set to the collection unit 3, only reject banknotes P at the time of the depositing from the banknote transport cassette 50 are present in the count reject storage unit 54, and reject banknotes P with different transaction contents are no longer mixedly present in the count reject storage unit 54. In this case, it is possible to accept the inventory amounts of the first to fifth storage cassettes 571 to 575. In a case where management of the inventory amounts of the first to fifth storage cassettes 571 to 575 is not required, the user may set the transport destination of the reject banknote P at the time of the dispensing to the dispensing unit 212 to the count reject storage unit 54. In a case where the management of the inventory amounts of the first to fifth storage cassettes 571 to 575 is required, on the other hand, the user may set the transport destination of the reject banknote P at the time of the dispensing to the dispensing unit 212 to the collection unit 3.

<Dispensing Processing to Banknote Transport Cassette>

In a case where a predetermined amount of the banknotes P is dispensed to the banknote transport cassette 50, the control unit 56 causes the banknote P in the storage unit 57 in the counterclockwise direction along the first transport path 581 and causes the recognition unit 215 to recognize the banknote P. Then, the control unit 56 causes a normal banknote P to be transported to the banknote transport cassette 50 and causes a reject banknote P to be transported to the upper reject storage unit 53.

<Collection Processing>

Next, the collection processing from the storage unit 57 to the collection unit 3 will be described. In the collection processing, the banknote P that can be collected (normal banknote P) is collected by the collection unit 3 and the banknote P that cannot be collected (reject banknote P) is transported to the count reject storage unit 54. Hereinafter, details of the collection processing will be described.

In a case where the banknote P in the first storage cassette 571, the second storage cassette 572, or the fourth storage cassette 574 is collected based on an operation of the operation unit, the control unit 56 causes the banknote P in the storage cassette to be transported in the counterclockwise direction along the first transport path 581 and causes the recognition unit 215 to recognize the banknote P. The control unit 56 then causes a normal banknote P to be transported to the collection unit 3 and causes a reject banknote P to be transported to the temporary storage unit 214.

When all the banknotes P to be collected are transported to the collection unit 3 or the temporary storage unit 214, the control unit 56 causes a reject banknote P in the temporary storage unit 214 to be transported in the clockwise direction along the first transport path 581 and causes the recognition unit 215 to recognize the reject banknote P. The control unit 56 then causes a reject banknote P recognized as a normal banknote P to be transported to the collection unit 3 and causes a reject banknote P recognized as a reject banknote P again to be transported to the count reject storage unit 54 or the collection unit 3. Whether the transport destination of the reject banknote P at the time of the collection is the count reject storage unit 54 or the collection unit 3 is set by, for example, the user.

In a case where the banknote P in the third storage cassette 573 or the fifth storage cassette 575 is collected based on an operation of the operation unit, on the other hand, the control unit 56 causes the banknote P in the storage cassette to be transported in the counterclockwise direction along the first transport path 581 and causes the recognition unit 215 to recognize the banknote P. The control unit 56 then causes a normal banknote P to be transported to the sixth storage cassette 576 and causes a reject banknote P to be transported to the temporary storage unit 214.

When all the banknotes P to be collected are transported to the sixth storage cassette 576 or the temporary storage unit 214, the control unit 56 causes a normal banknote P in the sixth storage cassette 576 to be transported in the clockwise direction along the first transport path 581 and then causes the normal banknote P to be transported to the collection unit 3. Further, the control unit 56 causes a reject banknote P in the temporary storage unit 214 to be transported in the clockwise direction along the first transport path 581 and causes the recognition unit 215 to recognize the reject banknote P. The control unit 56 then causes a reject banknote P recognized as a normal banknote P to be transported to the collection unit 3 and causes a reject banknote P recognized as a reject banknote P again to be transported to the count reject storage unit 54 or the collection unit 3. Whether the transport destination of the reject banknote P at the time of the collection is the count reject storage unit 54 or the collection unit 3 is set by, for example, the user.

<Reconciliation Processing>

Next, the reconciliation processing of the storage unit 57 will be described. In the reconciliation processing, a normal banknote P is returned to a storage cassette to be reconciled and a reject banknote P is transported to the dispensing unit 212. Hereinafter, details of the reconciliation processing will be described.

In a case where the reconciliation processing of one storage cassette of the first to fifth storage cassettes 571 to 575 is performed based on an operation of the operation unit, the control unit 56 causes the banknote P in the storage cassette to be reconciled to be transported in the counter-clockwise direction along the first transport path 581 and causes the recognition unit 215 to recognize the banknote P. The control unit 56 then causes a normal banknote P to be transported to the sixth storage cassette 576 and causes a reject banknote P to be transported to the temporary storage unit 214.

When all the banknotes P to be reconciled are transported to the sixth storage cassette 576 or the temporary storage unit 214, the control unit 56 causes a normal banknote P in the sixth storage cassette 576 to be transported in the clockwise direction along the first transport path 581 and causes the recognition unit 215 to recognize the normal banknote P. The control unit 56 then causes a normal banknote P recognized as a normal banknote P again to be transported to the original storage cassette and causes a normal banknote P recognized as a reject banknote P to be transported to the temporary storage unit 214. Thereafter, the control unit 56 causes the reject banknote Pin the temporary storage unit 214 to be transported in the clockwise direction along the first transport path 581 and causes the reject banknote P to be transported to the dispensing unit 212 without causing the reject banknote P to pass through the recognition unit 215.

The invention claimed is:

1. An aligner, comprising:

a transport path;

a linear-motion transport unit that comprises a linear-motion drive roller and generates a drive force to a sheet on the transport path, the drive force being a drive force in a transport direction along the transport path;

a left-skew transport unit that is disposed in a left direction with respect to the transport direction of the linear-motion transport unit, comprises a left-skew drive roller and generates a drive force to the sheet on the transport path, the drive force being a drive force in a left-oblique direction inclined in the left direction;

a right-skew transport unit that is disposed in a right direction with respect to the transport direction of the linear-motion transport unit, comprises a right-skew drive roller and generates a drive force to the sheet on the transport path, the drive force being a drive force in a right-oblique direction inclined in the right direction; and a control unit that controls the linear-motion transport unit, the left-skew transport unit, and the right-skew transport unit such that the sheet is transported while being selectively shifted leftward or rightward in the transport direction, wherein the linear-motion drive roller, the left-skew drive roller, and the right-skew drive roller are disposed on a side of one main surface of the sheet, in the case where the sheet is shifted in the left direction, the control unit causes the linear-motion drive roller and the left-skew drive roller to come into contact with the sheet and to rotate such that a component of velocity of the left-skew drive roller in the transport direction is identical to a velocity of rotation of the linear-motion drive roller, and in the case where the sheet is shifted in the right direction, the control unit causes the linear-motion drive roller and the right-skew drive roller to come into contact with the sheet and to rotate such that a component of velocity of the right-skew drive roller in the transport direction is identical to the velocity of rotation of the linear-motion drive roller.

2. The aligner according to claim 1, wherein positions of the linear-motion transport unit, the left-skew transport unit, and the right-skew transport unit are set so as to be arranged in a row in a direction orthogonal to the transport direction.

3. A sheet width alignment method to be executed by an aligner that transports a sheet on a transport path, the sheet width alignment method comprising transporting, by the aligner, a plurality of the sheets while selectively shifting the plurality of sheets leftward or rightward in a transport direction of the sheet for each predetermined number of one or the plurality of sheets, wherein:

in the transporting, a user is caused to perform selection of transport processing, and in the transporting, the aligner is caused to perform width alignment transport processing or linear-motion transport processing based on the selection of the user, the width alignment transport processing being processing of transporting the plurality of sheets while aligning the plurality of sheets in the left direction or the right direction for the each predetermined number of the one or plurality of sheets, the linear-motion transport processing being processing of transporting the plurality of sheets without aligning the plurality of sheets in the left direction or the right direction.

4. The sheet width alignment method according to claim 3, wherein in the transporting, the aligner selectively performs width alignment transport processing or linear-motion transport processing based on a transport destination of the plurality of sheets, the width alignment transport processing being processing of transporting the plurality of sheets while aligning the plurality of sheets in the left direction or the right direction for the each predetermined number of the one or plurality of sheets, the linear-motion transport processing being processing of transporting the plurality of sheets without aligning the plurality of sheets in the left direction or the right direction.

5. The sheet width alignment method according to claim 4, wherein the aligner performs the width alignment transport processing in a case where the transport destination is a collection unit that collects the sheet.

6. An aligner, comprising:

a transport path;

a linear-motion transport unit that comprises a linear-motion drive roller and generates a drive force to a sheet on the transport path, the drive force being a drive force in a transport direction along the transport path;

a left-skew transport unit that is disposed in a left direction with respect to the transport direction of the linear-motion transport unit, comprises a left-skew drive roller and generates a drive force to the sheet on the transport path, the drive force being a drive force in a left-oblique direction inclined in the left direction; and a right-skew transport unit that is disposed in a right direction with respect to the transport direction of the linear-motion transport unit, comprises a right-skew drive roller and generates a drive force to the sheet on the transport path, the drive force being a drive force in a right-oblique direction inclined in the right direction; and a control unit that controls the linear-motion transport unit, the left-skew transport unit, and the right-skew transport unit such that the sheet is transported while being selectively shifted leftward or rightward in the transport direction, wherein the linear-motion drive roller, the left-skew drive roller, and the right-skew drive roller are disposed on a side of one main surface of the sheet, the linear-motion transport unit, the left-skew transport unit, and the right-skew transport unit each overlap when viewed from a direction perpendicular to the transport direction, in the case where the sheet is shifted in the left direction, the control unit causes the linear-motion drive roller and the left-skew drive roller to come into contact with the sheet and to rotate at same time, and in the case where the sheet is shifted in the right direction, the control unit causes the linear-motion drive roller and the right-skew drive roller to come into contact with the sheet and to rotate at same time.

* * * * *